US006299492B1

(12) United States Patent
Pierini et al.

(10) Patent No.: US 6,299,492 B1
(45) Date of Patent: Oct. 9, 2001

(54) ELECTRICAL CONNECTORS

(75) Inventors: John M. Pierini, Sunrise; Christopher Weaver, Fort Lauderdale, both of FL (US)

(73) Assignee: A. W. Industries, Incorporated, Ft. Lauderdale, FL (US)

( * ) Notice: Subject to any disclaimer, the term of this patent is extended or adjusted under 35 U.S.C. 154(b) by 0 days.

(21) Appl. No.: 09/268,360

(22) Filed: Mar. 15, 1999

Related U.S. Application Data

(60) Provisional application No. 60/103,484, filed on Sep. 24, 1998, and provisional application No. 60/097,247, filed on Aug. 20, 1998.

(51) Int. Cl.[7] ..... H01R 13/02; H01R 13/73
(52) U.S. Cl. ..... 439/884; 439/947
(58) Field of Search ..... 439/862, 947, 439/78, 665, 735, 80, 81, 79, 884

(56) References Cited

U.S. PATENT DOCUMENTS

| | | | |
|---|---|---|---|
| D. 301,870 | 6/1989 | Shibano | D13/24 |
| D. 368,071 | 3/1996 | Eaton | D13/147 |
| D. 372,220 | 7/1996 | Matthews | D13/133 |
| D. 372,222 | 7/1996 | Matthews | D13/154 |
| D. 405,417 | 2/1999 | Matthews | D13/147 |
| D. 408,361 | 4/1999 | Chau et al. | D13/147 |
| D. 408,789 | 4/1999 | Middlehurst et al. | D13/154 |
| D. 409,576 | 5/1999 | Wood et al. | D13/154 |
| D. 410,894 | 6/1999 | Chau et al. | D13/147 |
| D. 411,173 | 6/1999 | Chau et al. | D13/147 |
| D. 412,489 | 8/1999 | Middlehurst et al. | D13/147 |
| 3,054,078 | 9/1962 | Baschkin . | |
| 3,456,231 | 7/1969 | Paullus et al. . | |
| 3,471,822 | 10/1969 | Van Baelen . | |
| 3,808,578 | 4/1974 | Hansen | 339/59 |
| 4,013,329 | 3/1977 | Hugin . | |
| 4,090,764 | 5/1978 | Malsby et al. . | |
| 4,379,611 | 4/1983 | Foege et al. | 339/217 |
| 4,550,959 | 11/1985 | Grabbe et al. . | |
| 4,561,711 | 12/1985 | Zrnich . | |
| 4,662,706 | 5/1987 | Foley | 339/256 |
| 4,662,760 | 5/1987 | Foley . | |
| 4,749,357 | 6/1988 | Foley | 439/80 |
| 4,824,380 | 4/1989 | Matthews | 439/78 |
| 4,854,899 | 8/1989 | Matthews | 439/724 |
| 4,867,713 | 9/1989 | Ozu et al. | 439/833 |
| 4,969,824 | 11/1990 | Casciotti | 439/62 |
| 5,055,055 | 10/1991 | Bakker | 439/78 |
| 5,088,942 | 2/1992 | Welsh et al. | 439/843 |
| 5,124,883 | 6/1992 | Bakker | 361/386 |
| 5,156,552 | 10/1992 | Zaderej et al. | 439/59 |
| 5,156,553 | 10/1992 | Katzumata et al. | 439/62 |

(List continued on next page.)

FOREIGN PATENT DOCUMENTS 0 549 960 A2 7/1993 (EP) .

OTHER PUBLICATIONS

Molex 1991 Catalog For Edge Card Connector 1991.
Elcon Dedicated Flatpaq Brochure From 1998 .

* cited by examiner

*Primary Examiner*—Brian Sircus
*Assistant Examiner*—Chandrika Prasad
(74) *Attorney, Agent, or Firm*—Lerner, David, Littenberg, Krumholz & Mentlik, LLP

(57) ABSTRACT

A connector especially useful as a power connector in electronic equipment has a housing adapted to receive any of several different types of contacts. One type of contact has a generally plainer, rectangular contact frame with integrally formed cantilever beams adapted to engage a mating contact and with integrally formed termination elements adapted to seat in vias of a circuit board. The connector provides a layer of resistance, cool-running reliable power connection which can be manufactured in a wide variety of styles at low cost. Male contacts having protruding contact beams also have contact frames which can be engaged in the housing.

35 Claims, 17 Drawing Sheets

U.S. PATENT DOCUMENTS

| | | | |
|---|---|---|---|
| 5,181,853 | 1/1993 | Van Brunt, Jr. et al. | 439/67 |
| 5,211,571 | 5/1993 | Arai et al. | 439/325 |
| 5,211,589 | 5/1993 | McCardell et al. | 439/879 |
| 5,261,840 | 11/1993 | Benz | 439/843 |
| 5,277,595 | 1/1994 | Clark | 439/75 |
| 5,306,182 | 4/1994 | Fukushima et al. | 439/857 |
| 5,316,486 | 5/1994 | Tanaka et al. | 439/62 |
| 5,342,226 | 8/1994 | Hayes et al. | 439/845 |
| 5,431,576 | 7/1995 | Matthews | 439/247 |
| 5,556,308 * | 9/1996 | Brown et al. | 439/746 |
| 5,575,690 | 11/1996 | Eaton | 439/717 |
| 5,575,691 | 11/1996 | Matthews | 439/744 |
| 5,591,039 | 1/1997 | Matthews | 439/181 |
| 5,676,571 | 10/1997 | Matthews | 439/843 |
| 5,713,764 | 2/1998 | Brunker et al. | 439/636 |
| 5,807,120 | 9/1998 | Matthews | 439/80 |

ELECTRICAL CONNECTORS

CROSS-REFERENCE TO RELATED APPLICATIONS

The present application claims benefit of U.S. Provisional Patent Application No. 60/103,484, filed Sep. 24, 1998 and U.S. Provisional Patent Application No. 60/097,247 filed Aug. 20, 1998. The disclosure of said provisional patent applications is incorporated herein by reference.

BACKGROUND OF THE INVENTION

The present application relates to electrical connectors.

Separable connectors are used in numerous electrical installations to carry signals and power between components. The most familiar examples of separable connector are used in numerous electrical plug and socket. More elaborate connectors are used to carry electrical power and signals between components of electronic equipment. For example, an electronic device such as a computer may include a main circuit board, commonly referred to as a "mother board", and one or more additional circuit boards, commonly referred to as "daughter boards". Each daughter board carries one connector, whereas the mother board carries the mating connectors. Each daughter board can be removed for service or upgrading by separating the connectors. Large electronic devices such as mainframe computers, computer networking hubs and industrial control installations often are built using a rack-mount system. In such a system the individual components are built on separate chassis. A large rack has slots which receive the chassis of the components in much the same way as the frame of a household dresser receives the individual drawer. Connectors mounted on the rack at the rear of the slots mate with connectors mounted on the individual components when the chassis are seated in the slots. The connectors on the rack are connected to one another as, for example by a large circuit board referred to as a "backplane", so that when the components are seated in the slots, the components are connected to one another.

Connectors for use in these and other applications must meet several demanding requirements. Those elements of the connectors which conduct power to the connected devices must carry substantial currents, which can range up to 100 amperes or more. Because the amount of heat generated in the connector is proportional to the square of the current and proportional to the resistance in the connector, the resistance in the connector must be very low. Other elements of the connectors, which conduct low-power signals such as computer data signals between connected devices also should provide low-resistance, reliable connections.

The connectors should be easy to engage and disengage, and should compensate for misalignment between the mating connectors. For example, the connectors should still function properly even if the circuit boards or other components holding the connectors are imperfect, so that the connectors are slightly out of alignment with one another. Also, the mating parts of the connectors should continue to function properly even if the components holding the connectors move or warp during service, so that a connector tilts slightly with respect to the mating connector.

Connectors must be manufactured in an almost infinite variety of configurations to meet different design requirements including the number of circuits to be connected and the current carrying capacity of individual elements. Orientation of the connector adds additional variations. For example, some connectors designed for mounting on circuit boards are arranged so that the mating connector can be engaged by moving it downwardly from above the circuit board. Other connectors are arranged so that the mating connector can be engaged by moving it horizontally, in a plane parallel to the plane of the circuit board. Also, some connectors are arranged so that as the mating connectors are engaged, particular electrical circuits established by the individual elements of the connector are made in a predetermined order matched to the electrical requirements of the devices to be connected. The need to accommodate all of these variations greatly complicates the task of designing and manufacturing connectors at a reasonable cost.

All of these considerations, taken together, present a formidable challenge. Many attempts have been made heretofore to satisfy these requirements. However, despite all of the efforts of the art heretofore, there has been a substantial need for improvement in connector design.

SUMMARY OF THE INVENTION

The present invention addresses these needs.

One aspect of the invention provides a connector including a housing having an entry face and a plurality of apertures open to the entry face, and a plurality of female contacts positioned within at least some of the apertures so that each such contact is associated with one of the apertures. Each female contact includes a contact body secured to the housing and one or more flexible cantilever beams having proximal ends connected to the contact body and distal ends remote from the contact body. The cantilever beams of the female contacts are arranged to engage a male contact element at contact points adjacent the distal ends of the cantilever beams. The female contacts associated with at least one of the apertures are "early-make" contacts with cantilever beams having distal ends and contact points adjacent the entry face and proximal ends remote from the entry face. The female contacts associated with at least one other aperture in the housing are "late-make" contacts with cantilever beams having distal ends and contact points remote from the entry face and proximal ends adjacent the entry face. When the connector is mated with a connector having male contact elements, the male contact elements enter the apertures of the housing. Because the contact points of the early-make contacts are disposed closer to the entry face than the contact points of the late-make contacts, the male contacts will engage the early-make contacts first, thereby making some of the electrical connections before others. The housing desirably has contact-mounting features associated with the apertures, and the contact bodies of the female contacts are engaged with these features of the housing.

The same connector may optionally include one or more male contacts having contact bodies and contact beams extending from the contact bodies. The contact bodies of the male contacts are disposed in one or more apertures of the housing and engaged with the contact mounting features associated with those apertures. The male contacts optionally can be provided in different lengths to provide early-make and late-make action with the mating connector. The apertures and contact-mounting features of the housing associated with the early-make female contacts, late-make female contacts and male contacts most preferably are identical with one another. Thus, the connector can be arranged to include any combination of early-make and late make female contacts and male contacts at different apertures, to meet different design requirements.

Most preferably, the female contacts are integral contacts having the cantilever beams formed integrally with the contact bodies. This provides a low-resistance current path from the cantilever beams to the contact bodies. Most preferably, the contacts have termination elements formed integrally with the contact bodies and projecting beyond the housing for engagement with a circuit board or other electrical components. The female contacts thus provide an integral, low-resistance current path free of joints from the contact points to the circuit board. Desirably, the contact body has a first thickness and at least a portion of each cantilever beam has a second thickness less than the first thickness.

According to a further aspect of the invention the contact bodies of the female contacts are generally planar, polygonal frames such as generally square frames. Each frame has sides extending at least partially around a central opening, the cantilever beams associated with each frame having their proximal ends connected to a proximal side of such frame and distal ends projecting across the central opening. The housing desirably defines contact-receiving slots in each said aperture, said frames being disposed in said slots. In a particularly preferred arrangement, each aperture in the housing has a central plane and the contact-receiving features of the housing at each aperture include slots disposed on opposite sides of the central plane. The female contacts may be provided in pairs, so that the contact bodies of each such pair being disposed in slots on opposite sides of the central plane of the aperture housing such pair. The cantilever beams of the female contacts extend from the contact bodies toward the central plane of the aperture.

According to a further aspect of the invention, each male contact may include a pair of generally polygonal contact frames and a contact beam projecting from the contact frames. Here again, the contact frames may be positioned in slots associated with an aperture of the housing so that a distal end of the contact beam projects out of the aperture beyond the entry face of the housing.

Connectors according to the foregoing aspects of the invention can be configured as top-entry or lateral-entry connectors. The housing of each type of connector has a bottom face which faces in a downward direction, and faces toward a circuit board or other mounting component in use. In a top-entry connector, the entry face of the housing faces upwardly, whereas in a lateral-entry connector, the entry face of the housing faces in a horizontal direction transverse to the downward direction. As mentioned above, the contacts arc provided with termination elements projecting from the bottom side of the contact bodies. The termination elements of the housing desirably project downwardly from the bottom face of the housing. Female and male contacts as discussed above may be provided in versions suitable for use in top-entry connectors and in right-handed or left-handed lateral entry connectors. The different versions of the female contact can be essentially identical to one another except for the orientation of the cantilever beams relative to the contact body and termination, whereas the different male contacts can be essentially identical to one another except for the orientation of the contact beams. As described further below, this provides for significant simplification in the tools required to make, handle and install the contacts.

Still further aspects of the invention provide contacts as discussed above, and sets of contacts incorporating some or all of the various types discussed above.

Yet another aspect of the invention provides methods of making contacts.

A still further aspect of the invention provides a connector for mounting on a circuit board, the connector having heat-dissipating features. A connector according to this aspect of the invention desirably includes at least one dielectric housing defining a bottom face and an entry face and electrically-conductive contacts disposed within the at least one housing. The contacts have termination elements projecting from the bottom face for mounting said housing on a circuit board with the bottom face facing toward the circuit board. The connector according to this aspect of the invention includes a thermally-conductive metallic heat dissipation element mounted in proximity to the at least one housing and the contacts but electrically isolated from the contacts. For example, the at least one housing may include a plurality of individual dielectric housings, and the heat dissipation element may includes a metallic element defining a plurality of cavities, the dielectric housings being received in said cavities. Alternatively, the heat dissipation element may include at least one bottom element projecting across the bottom face between said termination elements. The heat dissipation element directs heat generated in the connector away from the circuit board, and thus protects the circuit board from heat damage.

Yet another aspect of the invention provides an electrical connector system which prevents damage to connectors caused by attempts to drive the connectors together when they are severely misaligned. A system according to this aspect of the invention includes first and second mating elements having matable electrical contacts thereon and mechanically interengageable guide elements carried on said first and second elements adjacent said electrical contacts. The guide elements are adapted to engage one another and guide the mating elements with respect to one another to assure that the electrical contacts mate correctly. For example, a rack-mounted component may have a guide pin, whereas the rack holding the component may have a mating element with a hole for receiving the pin. According to this aspect of the invention, signal means are provided for detecting proper interengagement of the guide elements before the contacts are mated with one another and providing a signal indicating whether or not said guide elements are properly interengaged with one another. This aspect of the invention is particularly useful with rack-mounted components or other installations where the connectors are not visible to technician making the connection.

DETAILED DESCRIPTION OF THE PREFERRED EMBODIMENTS

Figure 1:
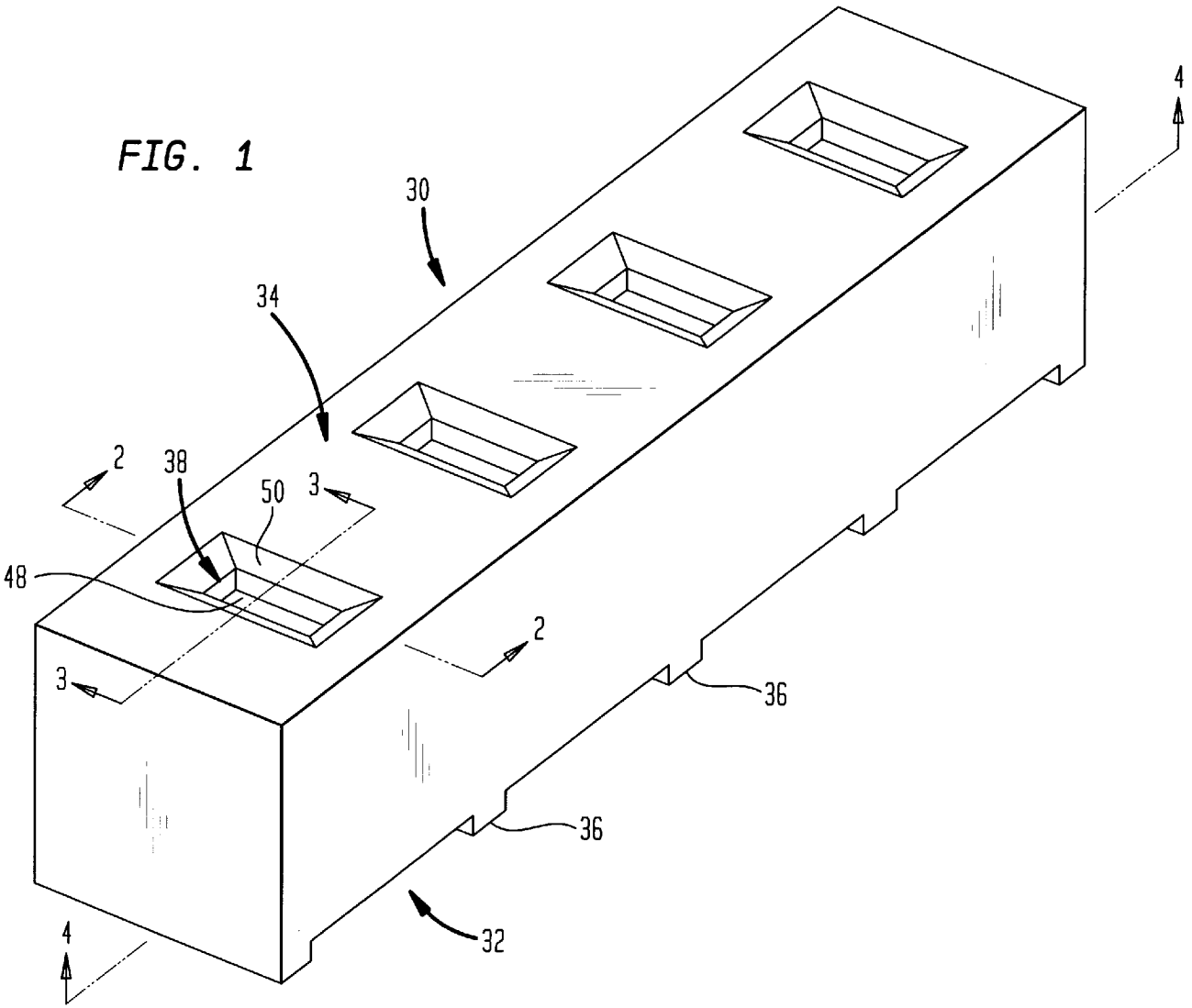
FIG. 1 is a diagrammatic perspective view depicting a housing of a connector in accordance with one embodiment of the invention.
Figure 2:
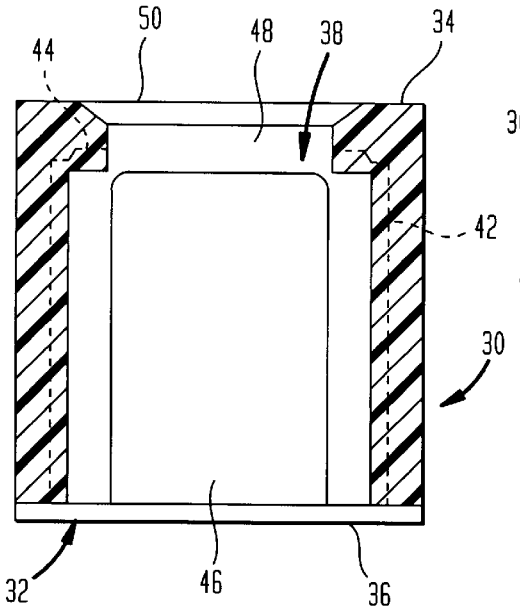
FIGS. 2, 3 and 4 are sectional views taken along lines 2—2; 3—3 and 4—4, respectively, in FIG. 1.

A connector in accordance with one embodiment of the present invention includes a housing 30. The housing has a bottom surface 32 and a top or entry surface 34 facing away from the bottom surface. The housing has ribs 36 projecting from the bottom surface. Ribs 36 extend generally parallel to one another across the bottom surface. The housing also has a set of apertures 38 extending through the housing, from the top or entry surface 34 to the bottom surface 32. Although only four apertures 38 are illustrated in FIG. 1, it should be appreciated that housing 30 can be of any size with any number of apertures. One or more apertures are disposed between each pair of ribs 36. Each aperture has a central plane 40 (FIGS. 3–4), and each aperture is generally symmetrical about central plane 40. Each aperture includes a pair of planar slots 42 (FIGS. 2, 3 and 4) extending into the housing from the bottom surface 32. Slots 42 extend in planes equidistant from the central plane of the aperture. Each slot 42 occupies a generally rectangular region of its plane, as seen in FIG. 2 in broken lines. Each slot also has a small tab portion 44 projecting from the remainder of the slot at the top of the slot, remote from bottom surface 32.

Figure 3:
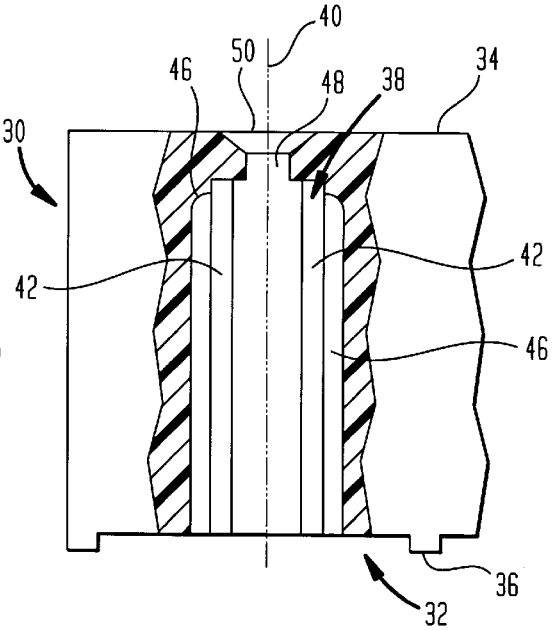
Figure 4:
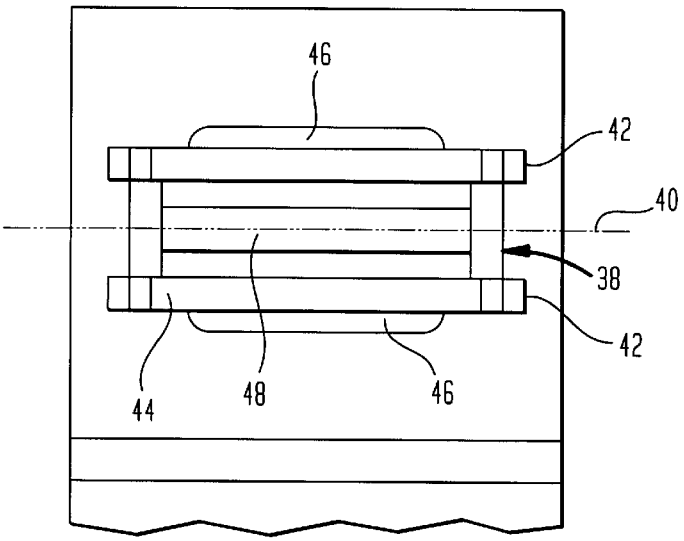

Each aperture also has a pair of overbend clearance chambers 46. As seen in FIGS. 3 and 4, overbend clearance chambers 46 project away from central plane 40 on the sides of slots 42 remote from the central plane. Each aperture 38 also includes an entry opening 48 having an outwardly flared lead-in region 50 opening to the top surface 34 of the housing. Housing 30 desirably is formed as an injection molding from a heat-resistant dielectric polymer. One example of such a polymer is a glass reinforced polyphthalalmide (PPA) resin of the type sold under the designation Amodel 4133XVO or Amodel AS-4133XHS by Amoco Polymers, Inc. of Alpharetta, Ga., USA.

The connector further includes a plurality of early-make female contact elements 52 (FIG. 5) formed from an electrically conductive metal such as beryllium, copper or other resilient, fatigue-resistance alloy. Each early-make female contact element has a contact body in the form of a rectangular, planar frame having a first or bottom frame member 54, a second or top member 53 and a pair of side frame members 56 extending vertically between the first and second frame members. The four frame members cooperatively surround a central opening 58. The top or second frame member 52 has an upper edge defining a tab similar in shape to the tab 44 (FIG. 2) provided at the top of each slot in the housing.

A set of press fit termination elements 60 are formed integrally with first or bottom frame member 54, and project downwardly from the bottom edge of such frame member. Each termination element has an elongated slot 62 extending through it, so that each termination element is compressible.

Each of the early-make female contact members has a set of cantilever beams 64 formed integrally with the frame. Each cantilever beam has a proximal end 66 connected to the frame at the first or bottom frame member 54 and a distal end 67 remote from the proximal end. The cantilever beams project partially across the internal opening 58 of the frame. However, the distal ends 67 of the cantilever beams are not attached to the frame. Stated another way, the cantilever beams are arranged as cantilever beams projecting from the first or bottom frame member 54. Each cantilever beam also has a contact point 68 close to its distal end. The cantilever beams are bent out of the plane of the frame, so that the contact points project from the plane of the rectangular frame or contact body. The cantilever beams desirably have thickness less than the thickness of the frame members. The thickness of the various parts will, of course, depend upon the size of the connector. By way of example, however, in an embodiment where the width-wise dimension W of each contact is about 0.454 inches, the frame members and termination elements may be about 0.025 inches thick, whereas the cantilever beams may be about 0.012 inches thick. The sides of vertically extensive frame members 56 may be provided with dimples 70 projecting from the edges of the frame.

Figure 6:
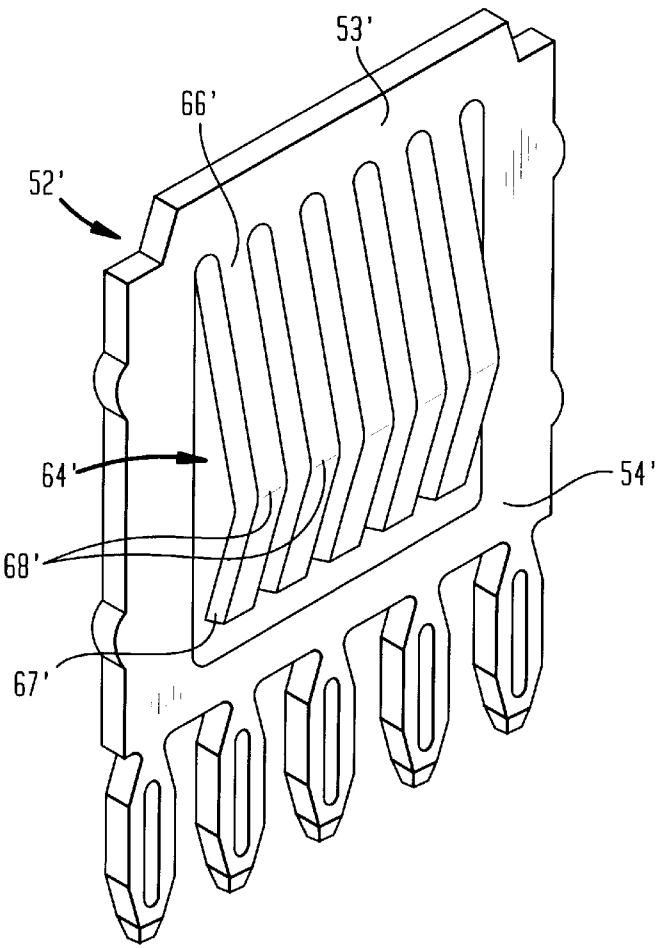
FIG. 6 is a view similar to FIG. 5 but depicting another contact used in the embodiment of FIGS. 1–5.

The connector also includes late-make female contacts 52' (FIG. 6). The late-make female contacts are identical to the early-make female contacts 52 (FIG. 5) except that in the late-make female contacts, the proximal ends 66' of cantilever beams 64' are disposed at the top or second frame member 53' rather than at the bottom of the first frame member 54', so that in the late-make female contacts, the cantilever beams project from the second or top frame member 52'. Thus, the distal ends 67' and contact points 68' of the cantilever beams are disposed adjacent the bottom or first frame member 54'.

Figure 5:
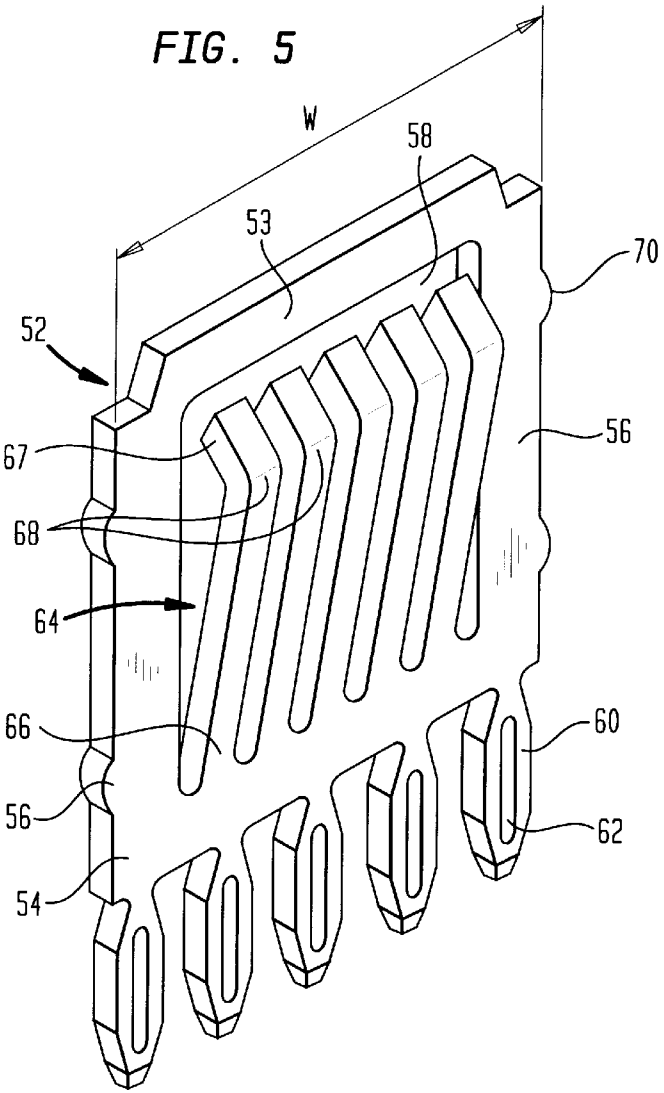
FIG. 5 is a perspective view of one contact used in the embodiment of FIGS. 1–4.
Figure 7:
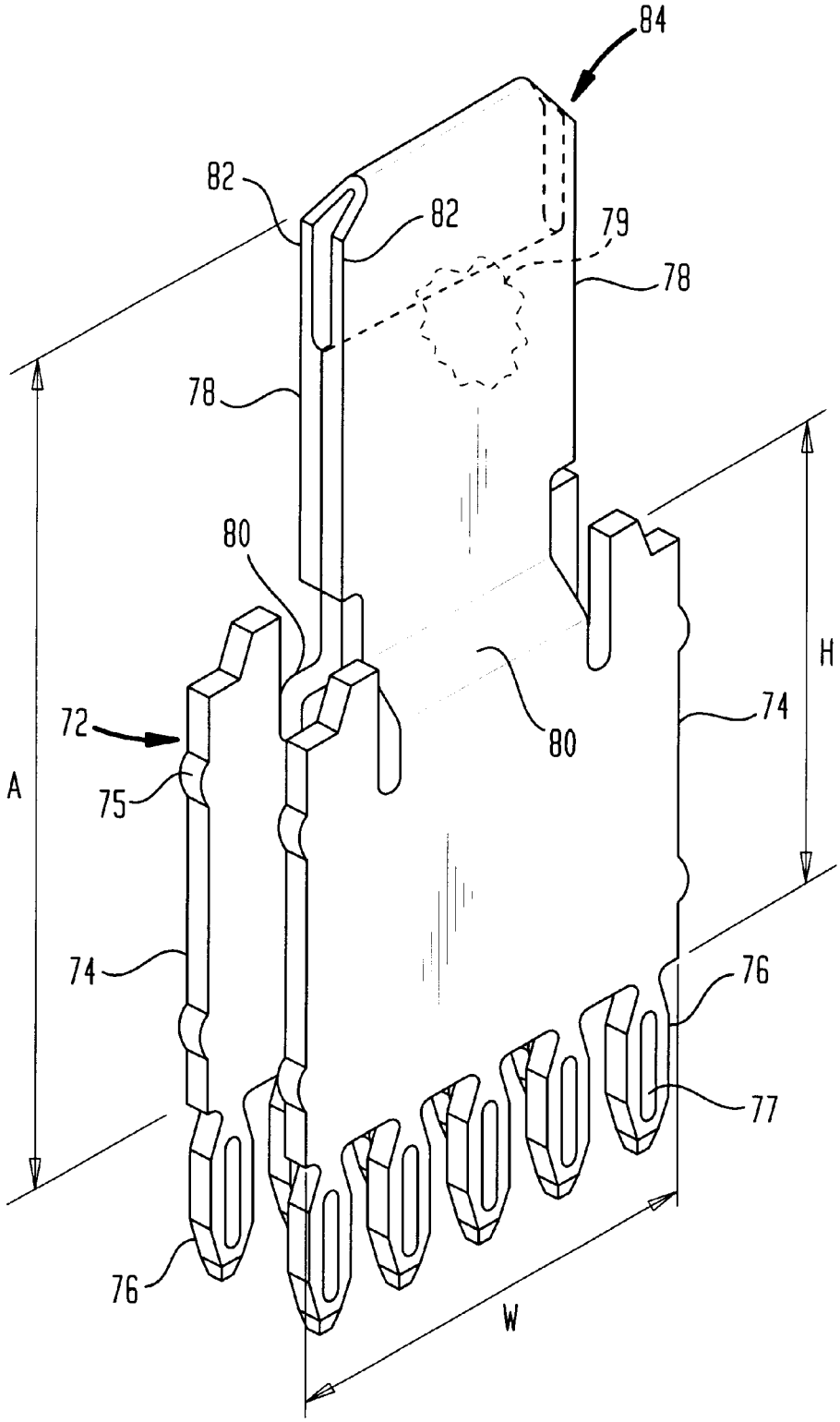
FIG. 7 is a view similar to FIG. 5 and but depicting another contact used in the embodiment of FIGS. 1–6.

The connector further includes male contact members 72 (FIG. 7). Each male contact member is formed as an integral, unitary element incorporating a pair of planar generally rectangular contact frames 74 of the same width W and height H as the contact frames of the female contacts (FIGS. 5 and 6). Contact frames 74 have dimples 75 projecting from their vertical edges, and have termination elements 76 projecting from their bottom edges. These termination elements have internal slots 77. The configuration of the termination elements 76 is the same as the termination elements provided on the female contacts. Each contact frame 74 has a generally planar beam element 78 joined to the top edge of the frame by an inwardly bent section 80, so that the beam elements 78 project upwardly from the contact frame 74. Beam elements 78 have reduced-thickness sections 82 at the ends of the beam elements remote from frame 74. The reduced-thickness sections 82 join with one another along a fold line. The beam elements 78 lie against one another and form a composite beam 84 projecting upwardly from the frame 74 along a central plane equidistant from frames 74. Contact beams 84 may be provided in different lengths on different male contacts. Merely by way of example, in a connector having frames 74 about 0.454 inches wide and having frame heights H of about 0.484 inches, four different types of male contacts may be provided, with different beam lengths so as to provide overall heights A as follows:

TABLE I

| Male Contact Type | Dimension A (Inches) |
|---|---|
| Extra Long | 1.10 |
| First Make | 1.024 |
| Normal | 0.944 |
| Last Make | 0.867 |

Because all of the various types of contacts have contact bodies or frames of the same configuration, any aperture 38 in housing 30 can accommodate any of the various types of contacts. In the particular connector shown in FIGS. 8 and 9, early-make female contact elements 52 are provided in apertures 38A and 38B, whereas late-make female contact elements 52' are provided in aperture 38D and a male contact 72 is provided in aperture 38C. The mating connector has the opposite types of contacts received in a similar housing 30'. The early-make female contacts are provided in pairs, one contact of each such pair being mounted on each side of the central plane of the associated aperture. The frame or planar contact body of each female contact is received in one of the slots 42 (FIGS. 3 and 4) of the aperture, with the first or bottom frame member 54 facing downwardly at the bottom of the housing, with the second or top frame member 53 facing upwardly, and with the vertical frame members 56 extending vertically in the slots. The cantilever beams 64 slope inwardly, from the plane of the frames and slots to the central plane 40 of the aperture. The widthwise dimension of the contact frame across the dimples is slightly greater than the corresponding dimension of the slot, so that dimples 70 dig into the polymer at the edges of the slot and hold the contact in place in the housing. The size of the dimples, and the degree of interference, is greatly exaggerated in FIG. 9 for clarity of illustration. In practice, the dimension across the dimples on the contact body exceeds the corresponding dimension of the slot in the housing by about 0.010 inches. Bottom or first frame member 54 may project slightly below the bottom surface 32 of the housing, but it does not project downwardly beyond the ribs 36. The press fit termination elements 60 project downwardly beyond the ribs 36 of the housing. With the early-make female contacts 52 installed in this orientation, the distal ends 67 of the cantilever beams project upwardly, toward the entry face 34 of the housing. Thus, the contact points 68 are disposed relatively close to the entry face 34 of the housing. The cantilever beams 64 of the contacts overlie the overbend clearance chambers 46 in the housing.

The late-make female contacts 52' are installed in precisely the same manner, with their frames in the same orientation relative to the housing. However, because the orientation of the cantilever beams relative to the frames is reversed in the late-make female contacts, the cantilever beams project downwardly, so that the distal ends 67' and contact points 68' of the late-make female contacts 52' are disposed relatively far from the entry face 34 of the housing. The planar contact frames 74 of the male contact members are received in the slots of the housing, and retained in the housing by engagement between the dimples 75 with the contact housing. Again, the frame members or contact bodies 74 may project slightly beyond the bottom surface of the housing, but do not project downwardly beyond the bottom of ribs 36. Also, the termination elements 76 of the male contacts projected downwardly beyond the ribs 36 on the bottom of the housing. The contact beam of each male contacts projects out of the housing and out of the associated aperture beyond the entry face 34 of the housing.

In use, the connector is mounted to a circuit panel such as a heavy-duty circuit board 90. The circuit board has vias or holes with hollow metallic liners 92 arranged in a pattern corresponding to the pattern of the termination members 60 and 74 on the connector. The termination members have a width dimension T (FIG. 9) slightly larger than the internal diameter of the vias, so that each termination member is compressed slightly during engagement in the via liner. The opening 62 within each termination member 60, and the corresponding openings 77 in the termination members 76 of the male contacts (FIG. 7) allow the termination members to deform during engagement with the via liners. The tapered shape of the termination members facilitates engagement in the via liners. During installation, the edges of the termination members wipe the interior of the via liners. This wiping action, together with the substantial engagement forces between the termination members and via liners provides a low resistance, gas-tight electrical contact between each termination member and the associated via liner. The term "gas-tight" means that the contacting surfaces of the termination members and via liners are intimately engaged with one another so that oxygen and other atmospheric gases will not enter between these surfaces, and therefore the contacting surfaces will not oxidize in service.

The engagement forces between the termination members and the via liners typically are sufficient to retain the connector in place, without further fasteners. Stated another way, the via connector can be installed on the circuit panel simply by placing the connector at the appropriate location on the circuit panel, with the tips of the termination members engaged in the via liners, and driving the connector home until the ribs 36 on the bottom of the housing engage the top surface of the circuit panel. The via liners 92 are electrically connected to the electrical components on the circuit panel, as by conventional traces extending along the surfaces of the circuit panel or within the circuit panel.

Figure 8:
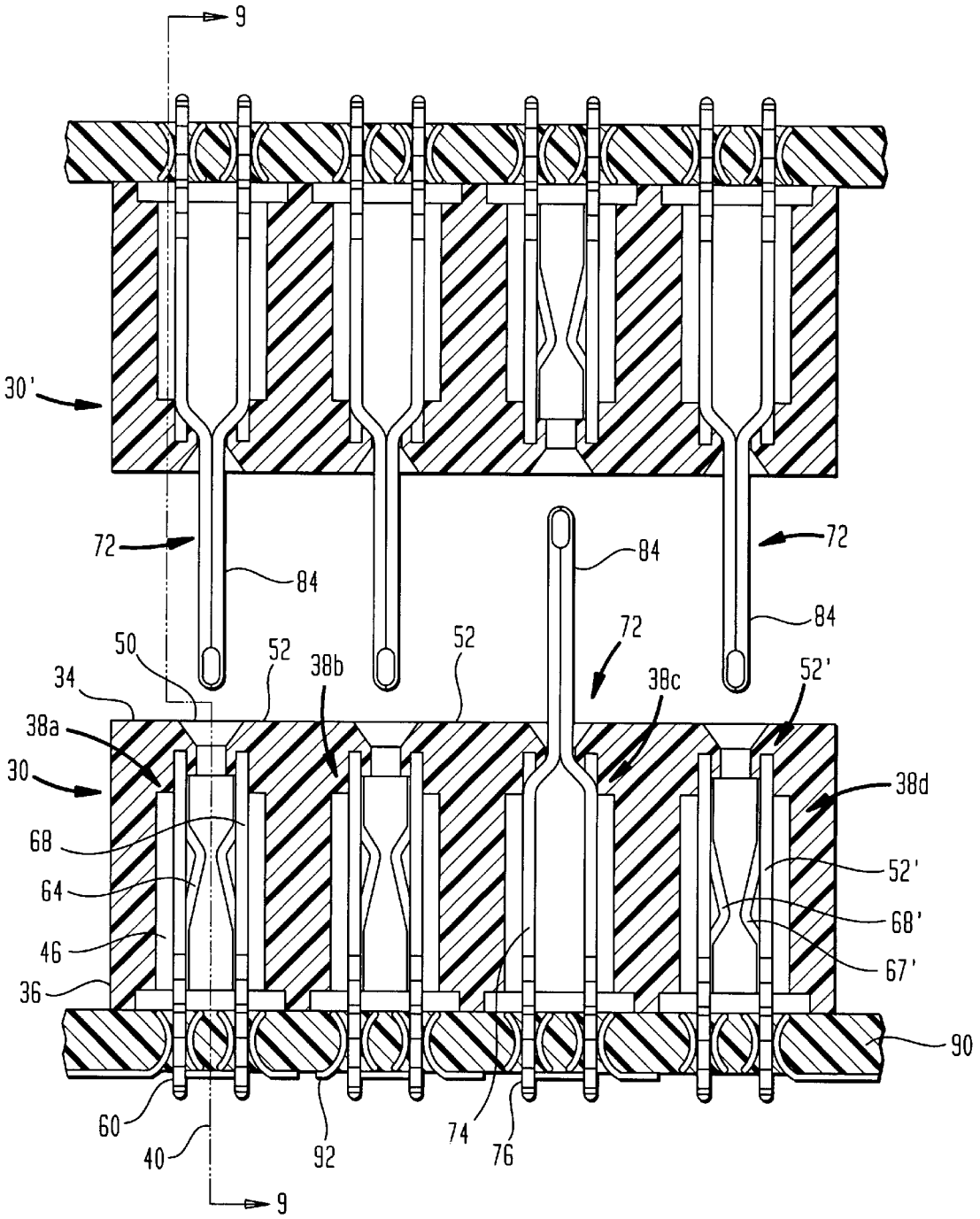
FIG. 8 is a sectional view of the connector of FIGS. 1–7 during engagement with a mating connector.
Figure 9:
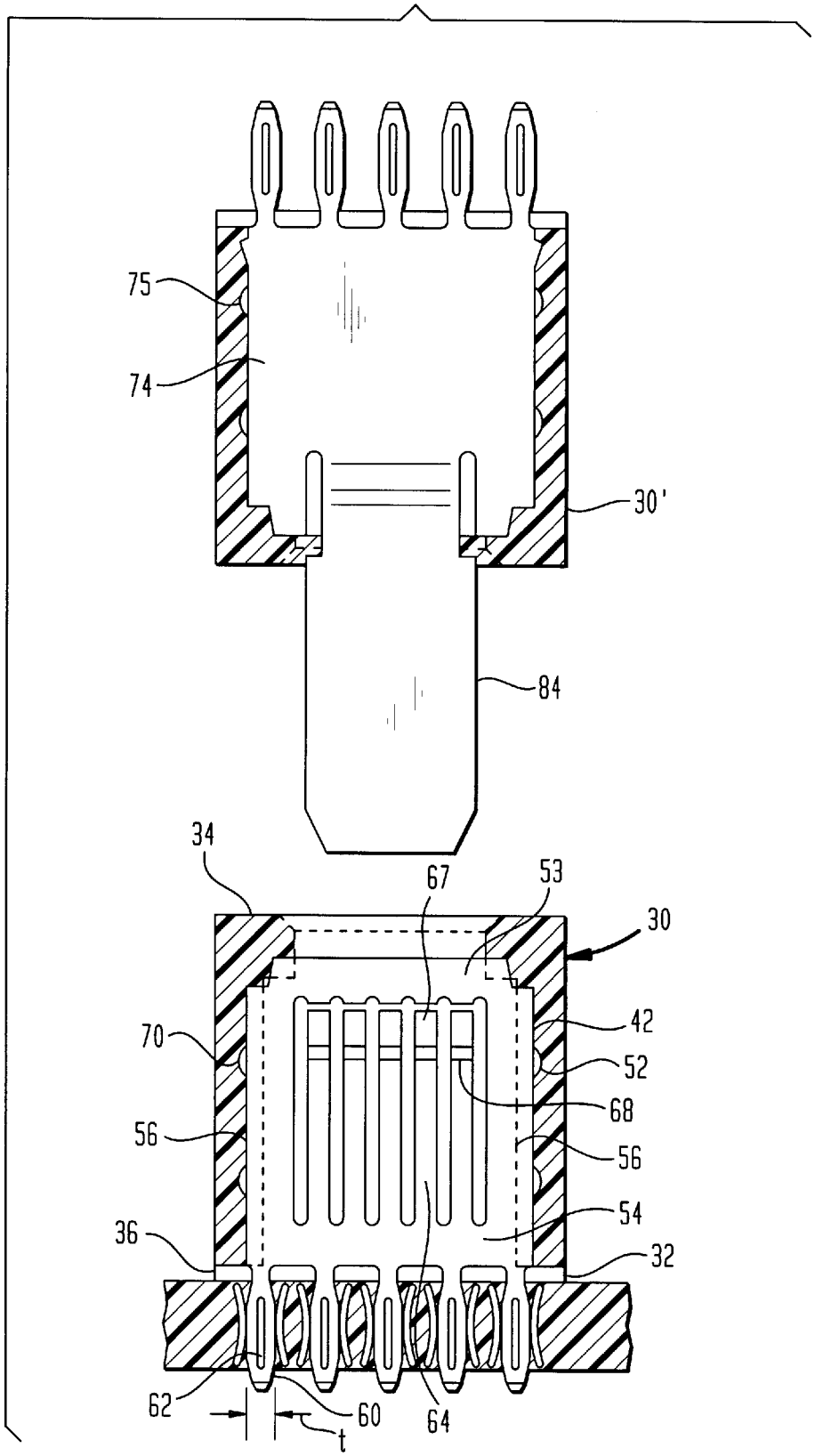
FIG. 9 is a sectional view taken along line 9—9 in FIG. 8.

With the connector in place on the circuit panel, the mating connector can be engaged as illustrated in FIGS. 8 and 9. The contact beams 84 of the male contacts on the mating connector enter the apertures through the entry openings and lead in regions 50, so that each contact beam passes downwardly into an aperture 38 holding a pair of female contacts. As the contact beams enter the apertures, they engage the cantilever beams of the female contact elements near their respective contact points 68, 68'. Provided that all of the contact beams 84 on the mating contact are of the same length, the contact beams will engage the early-make female contact elements before they engage the late-make female contact elements. This early-make and late-make action assures that different electrical circuits will be completed at different times during engagement of the connectors with one another. As the contact beams advance into the apertures of the housing, they force the cantilever beams outwardly. The overbend clearance chambers 46 in the housing accommodate outward deflection of the cantilever beams. The sloping surfaces on the cantilever beams, as well as the curved tips on the ends of the beam elements 84 facilitate engagement of the cantilever beams with the beam elements. Also, the motion of the beam elements into the apertures provides for a wiping action and helps to assure reliable, low-resistance electrical contact between the beam elements and the cantilever beams. Because the cantilever beams are relatively thin, they can accommodate significant outward displacement without excessive stress. For example, in a typical embodiment, the cantilever beams of each female contact may be bent outwardly through a distance of about 0.008–0.010 inches or more during engagement with the male contact beam. Such a large initial displacement helps to assure that the cantilever beams will remain engaged with the male contact beam even if the circuit boards and contact housings shift or tilt relative to one another.

The engaged connectors provide low resistance electrical connections. The reliable, low-resistance connections between the cantilever beams and the beam elements, and between the termination elements and the vias of the circuit panel, minimize the internal resistance of the connection. Also, because the cantilever beams of the female contacts arc formed integrally with the frames and termination elements, the electrical resistance within each female contact is very low. Similarly, because the beam elements of the male contacts arc formed integrally with the termination elements and frames, the internal resistance within each male contact is very low. All of these factors help to minimize resistance within the connection. This allows the connector to carry substantial currents without excessive heating. Merely by way of example, certain connectors in accordance with particular embodiments of the invention can carry currents of about 30–40 amperes per connection, and in some cases up to 100 amperes per connection, without overheating the connector or the adjacent regions of the circuit board. Connectors for high currents typically have thicker metallic elements than low-current connectors. Among other applications, such high-current connectors can be used for making power circuit connections in large computer assemblies.

Figure 10:
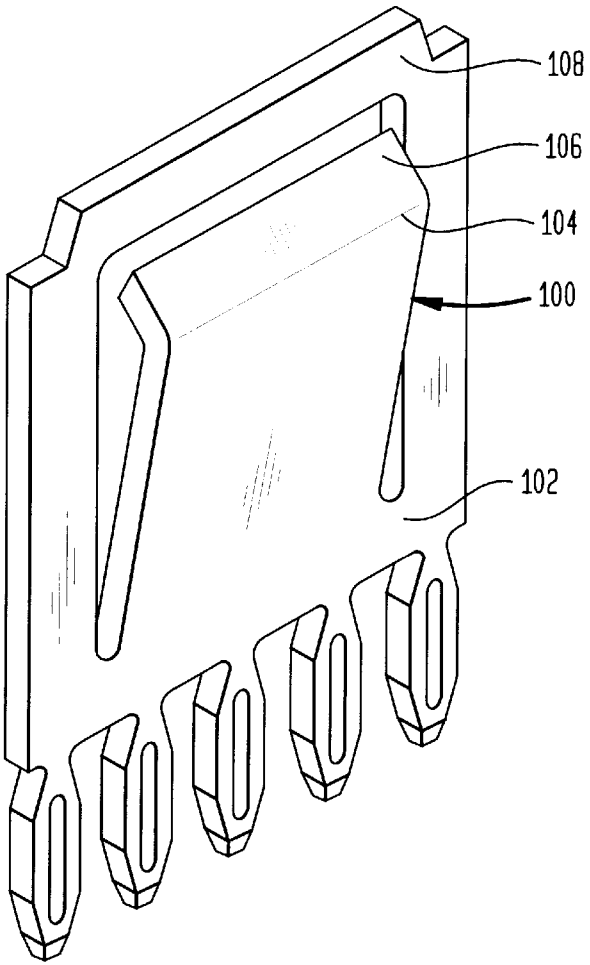

An early-make female contact according to a further embodiment (FIG. 10) is identical to the early-make female contact discussed above, except that the contact of FIG. 10 has only a single, broad cantilever beam or cantilever beam 100 projecting from the first or bottom frame member 102. Like the cantilever beams discussed above, cantilever beam 100 slopes out of the plane of the frame, and has a contact region 104 adjacent its distal end 106.

Figure 11:
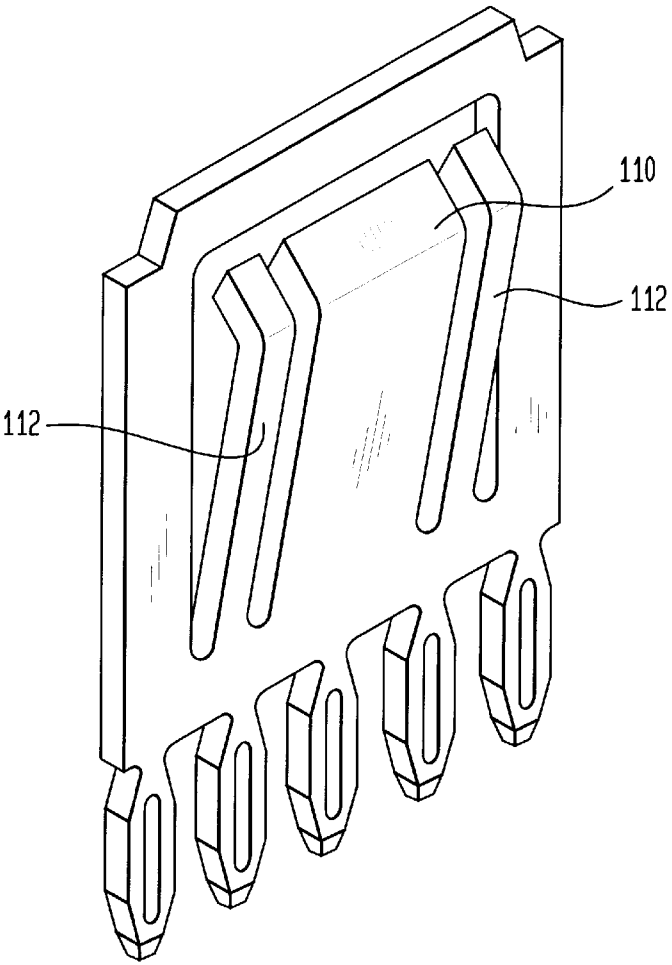
FIGS. 10, 11 and 12 are perspective views depicting contacts in accordance with further embodiments of the invention.
Figure 12:
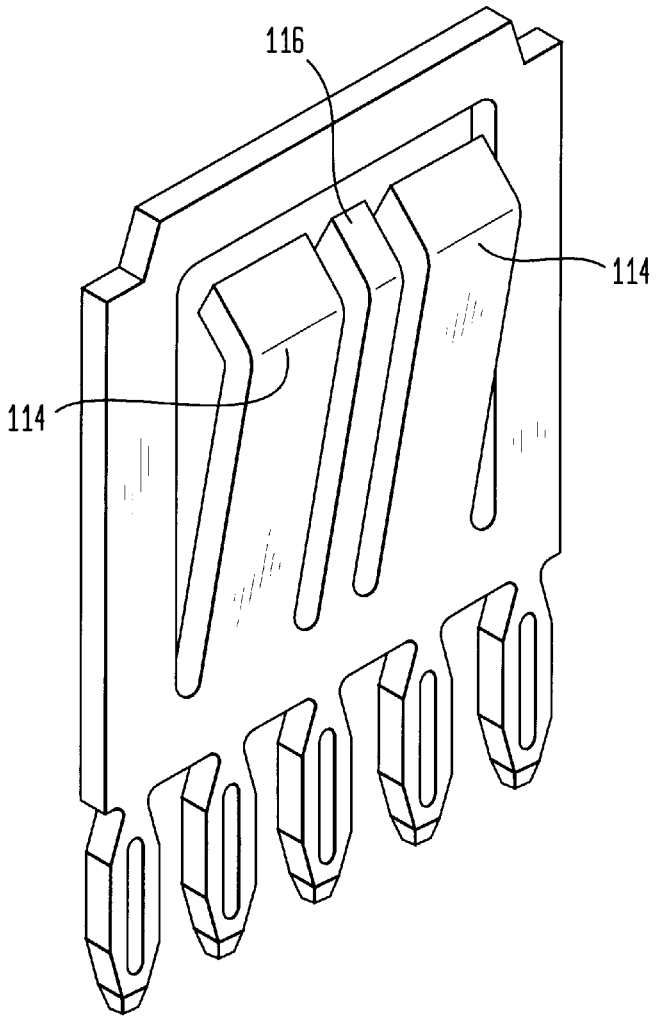
Figure 13:
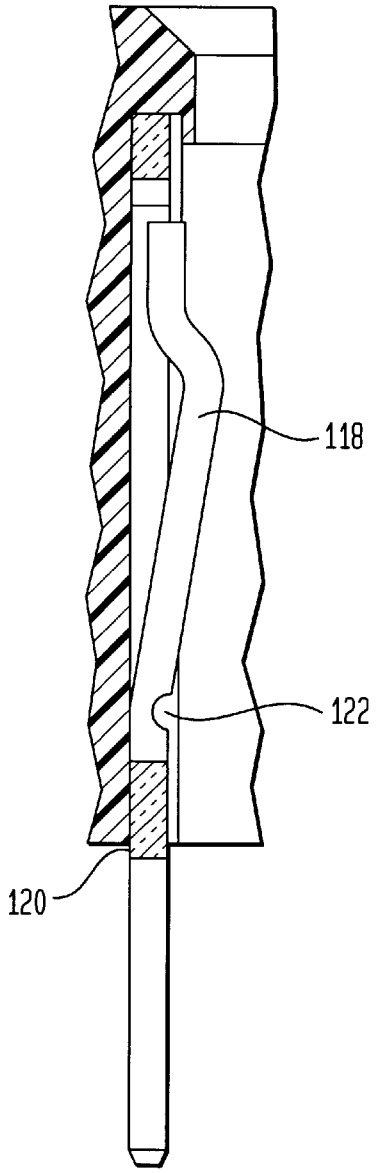
FIG. 13 is a fragmentary sectional view depicting a contact and housing in accordance with a further embodiment.

A contact according to a further embodiment (FIG. 11) has cantilever beams of unequal width, including a broad primary cantilever beam 110 and a pair of relatively thin, secondary cantilever beams 112 disposed on either side of the primary cantilever beam. The reverse arrangement (FIG. 12) including two broad primary cantilever beams 114 and a narrow secondary cantilever beam 116 (FIG. 12). In a contact according to a further variant, the cantilever beams 11 8 have substantially the same thickness as the frame 120, except that each cantilever beam has a locally thinned section 122 adjacent to the proximal end of the cantilever beam.

Figure 14A:
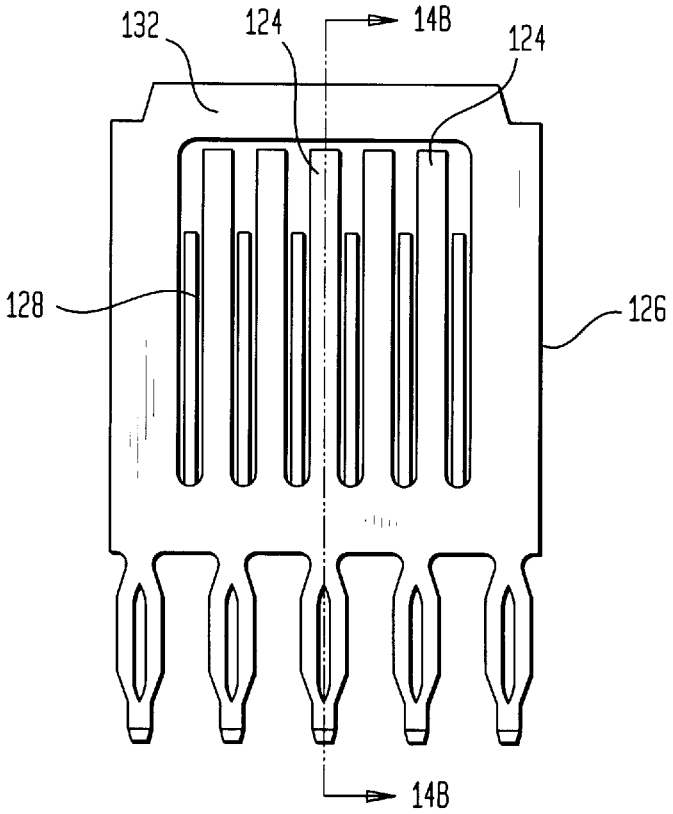
FIG. 14A is an elevational view of a contact in accordance with yet another embodiment of the invention.
Figure 14B:
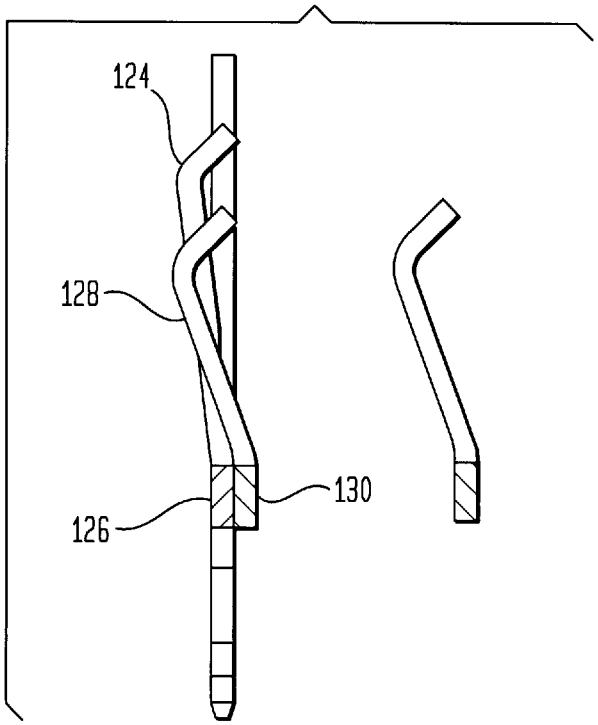
FIG. 14B is a sectional view taken along line 14B—14B in FIG. 14A.

A contact according to yet another variation (FIG. 14) includes principal cantilever beams 124 formed integrally with the frame 126, and also includes a set of adjunct cantilever beams 128 formed integrally with a separate metallic strip 130. Strip 130 is welded to frame 126 adjacent to the proximal ends of the principal cantilever beams 124, so that the adjunct cantilever beams extend in the same direction as the principal cantilever beams. In service, the adjunct cantilever beams will contact the male contact beam and will carry a part of the electrical current. In a further variant, the direction of the adjunct cantilever beams can be reversed. Thus, strip 130 may be fastened to the distal frame member 132 adjacently distal ends of the cantilever beams, so that the distal ends of the adjunct cantilever beams project towards the proximal ends of the primary cantilever beams, i.e., towards the bottom of the drawing as seen in FIG. 14.

The arrangements of FIGS. 10–14 can be used in a late-make female contact, except that the cantilever beams extend from the top or second frame element, so that the proximal ends of the cantilever beams are disposed at the top of the frame and the tip or distal ends of the cantilever beams point downwardly, towards the bottom end of the contact frame.

Figure 15:
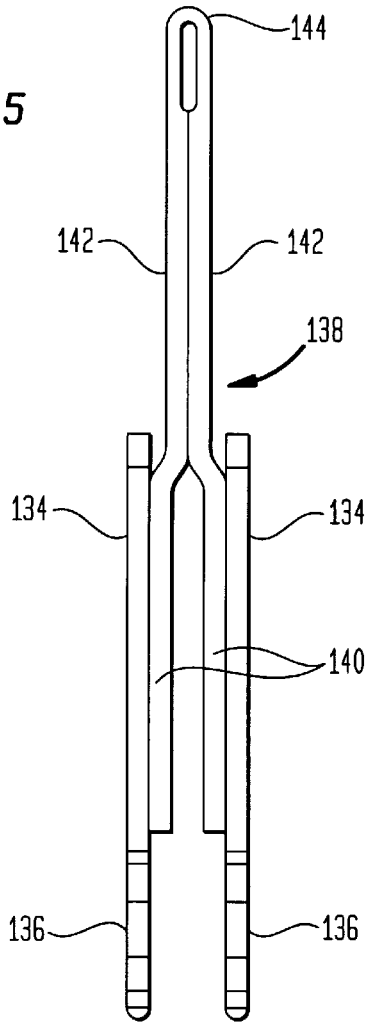
FIG. 15 is an elevational view of a contact in accordance with yet another embodiment of the invention.

A male contact in accordance with an alternate embodiment (FIG. 15) includes a pair of planar contact frames or bodies 134 formed integrally with the termination elements 136. The contact frames 134 have the same generally rectangular shape as the other contact frames discussed above. A separate contact beam 138 includes a pair of plates 140 integral with a pair of beam elements 142. Beam elements 142 are folded over on one another so as to define a composite contact beam projecting upwardly from frames 134. Beam 138 includes a thinned portion 144 at the tip of the composite beam. During manufacture, the beam is folded at the thinned portion to bring beam elements 142 into engagement with one another. The composite beam illustrated in FIG. 15, and the composite beam 84 of the male contact member discussed above with reference to FIG. 7, may optionally include a solder or other conductive filler (79, FIG. 7) disposed between the individual beam elements so as to bond the beam elements to one another. Such a conductive filler reduces the internal resistance of the contact beam. Alternatively or additionally, the beam elements may be welded to one another. In the male contact member of FIG. 15, the plates 140 of the beam unit are joined to the contact frames 134, as by welding or soldering. A multi-part male contact as illustrated in FIG. 15 is generally less preferred because the joint between the plates of the beam unit and the contact frames introduces some electrical resistance into the contact. These effects can be minimized by welding or soldering the elements to one another over a large area. Where spot-welding is employed, numerous spot welds should be used so as to provide numerous current paths.

Figure 16:
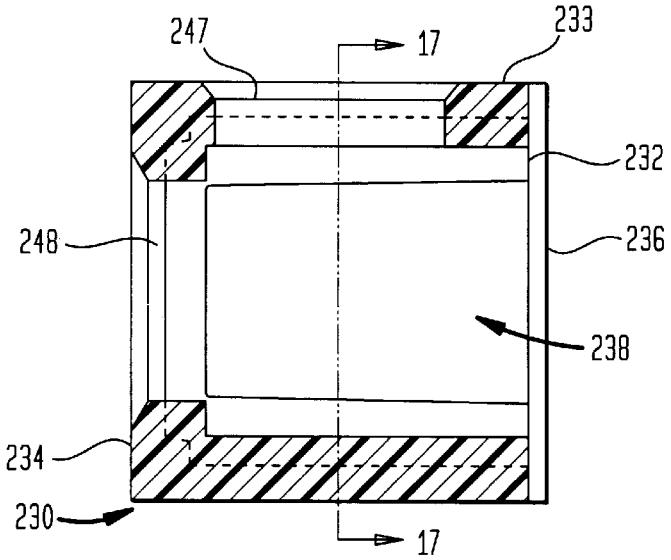
FIG. 16 is a sectional view of a housing in accordance with a still further embodiment of the invention.
Figure 17:
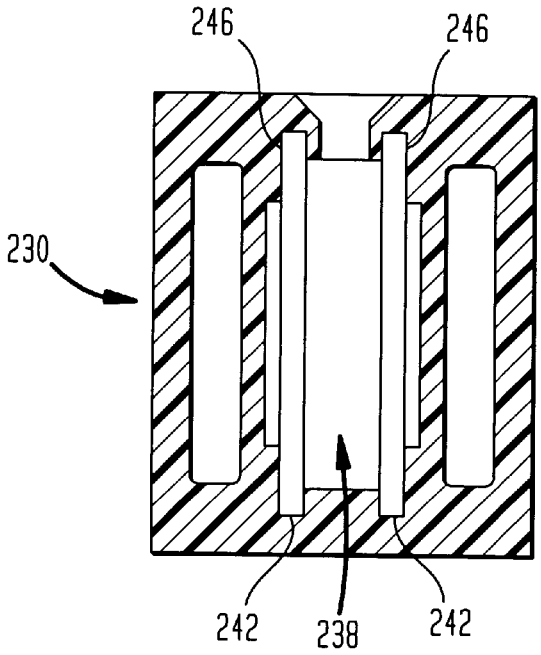
FIG. 17 is a sectional view taken along line 17—17 in FIG. 16.

A connector in accordance with a further embodiment of the invention includes a housing 230 (FIGS. 16 and 17) similar to the housing 30 discussed above with reference to FIGS. 1–4. However, housing 230 defines a lateral entry face 233 transverse to the bottom face 232 of the housing, in addition to the entry face 234 at the top of the housing. Thus, each aperture 238 has a side entry opening 247 communicating with the aperture through the side entry face 233, in addition to the top entry opening 248 communicating with the aperture through the top entry face 234. In other respects, housing 230 is similar to the housing 30 discussed above. Thus, housing 230 includes slots 242 disposed on opposite sides of the medial or central plane of each aperture 238, and overbend clearance chambers 246 disposed outboard of the slots. The housing also includes ribs 236 on the bottom face 232.

Figure 19:
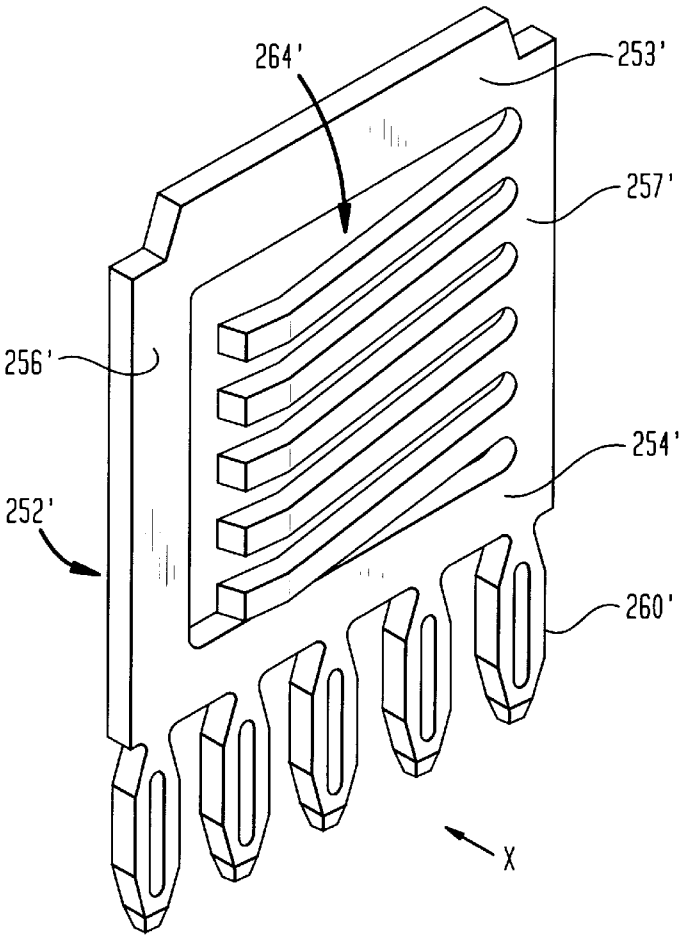
FIGS. 18 and 19 are perspective views depicting contacts usable with the housing of FIGS. 16 and 17.
Figure 18:
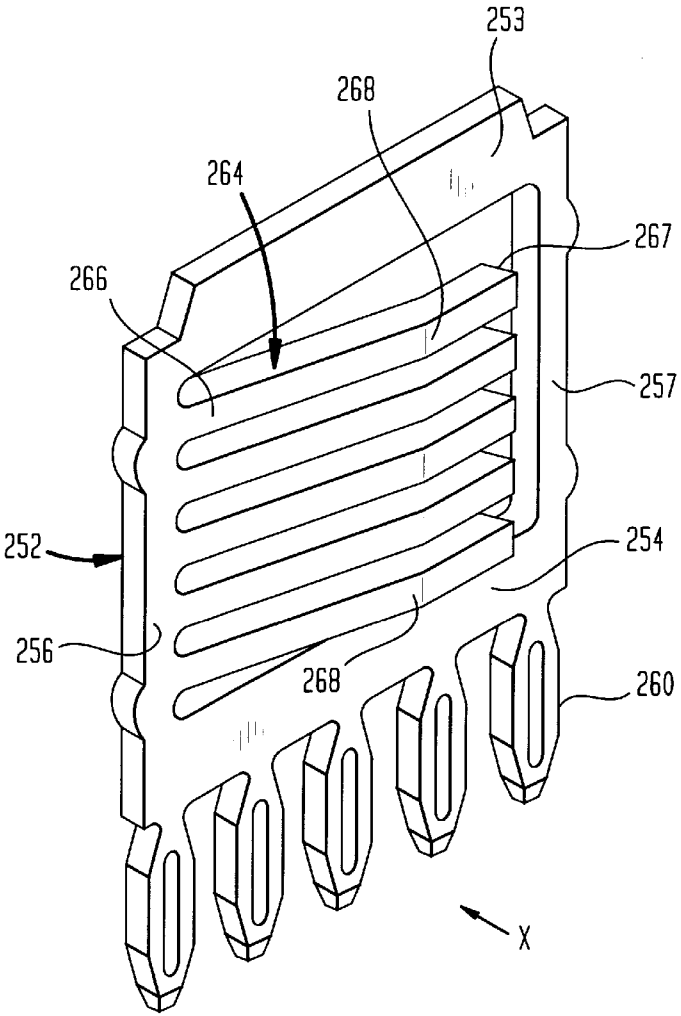

Housing 230 can also be used with lateral or right-angle contacts as shown in FIGS. 18 and 19. A first type of lateral contact (FIG. 18) has a planar contact frame 252 having exterior shape and dimensions identical to the contact frames discussed above with reference to FIGS. 5 and 6. Thus, frame 252 includes a first or bottom frame member 254; a second or top frame member 253 extending parallel to the bottom frame member, and vertical frame members including a third frame member 256 and a fourth frame member 257 extending parallel to one another and perpendicular to the top and bottom frame members. As in the embodiments discussed above, termination elements 260 are formed integrally with the frame and project downwardly from bottom frame member 254, and hence away from the top or second frame member 253.

The cantilever beams 264 of the contact illustrated in FIG. 18 have their proximal ends 266 at the third frame member 256, and their distal ends 267 adjacent to the fourth frame member 257. Thus, cantilever beams 264 project in a first horizontal direction, parallel to the first and second frame members 256. The cantilever beams 264 of the contact illustrated in FIG. 18, like the cantilever beams discussed above with reference to other embodiments, slope out of the plane of the frame, so that the contact points 268 of the cantilever beams project to the front of the plane of the frame, i.e. towards the viewer as seen in FIG. 18.

A lateral contact although the opposite type (FIG. 19) has a frame 252' and termination elements 260' identical to the frame and termination elements of the contact depicted in FIG. 18. However, the cantilever beams 264' project from the fourth frame member 257' towards the third frame member 256'. The cantilever beams extend in a second direction parallel to the first or bottom frame member 254' and parallel to the second or top of frame member 253'. The positions of the proximal and distal ends of the cantilever beams are reversed relative to the positions in FIG. 18. Because the cantilever beams of the contact depicted in FIG. 18 project from the left-hand side of the frame, when viewed in the direction of arrow X, from the front of the contact, the contact depicted in FIG. 18 is referred to herein as a left-hand lateral contact. The contact of FIG. 19 is referred to as a right-hand lateral contact, because the cantilever beams project from the right side of the frame when seen from the front of the contact, as indicated by arrow X.

Figure 20:
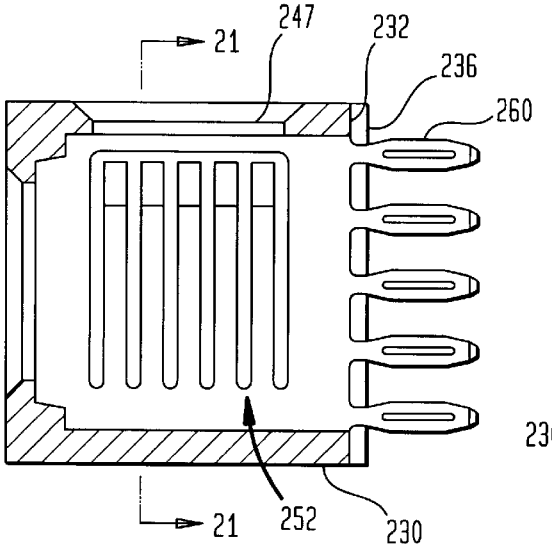
FIG. 20 is a sectional view of the connector incorporating the housing of FIGS. 16 and 17.
Figure 21:
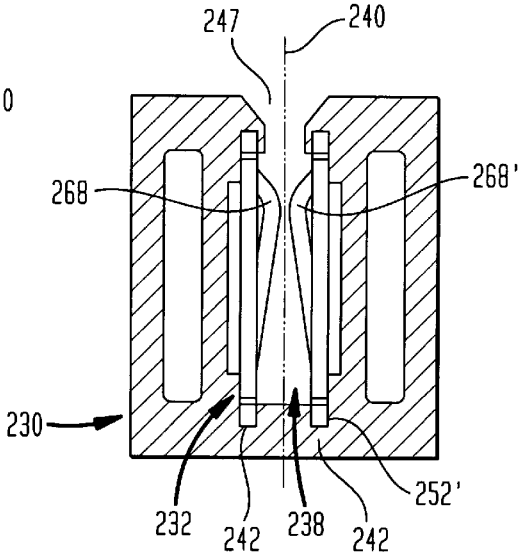
FIG. 21 is a sectional view taken on line 21—21 in FIG. 20.

The lateral contacts of FIGS. 18 and 19 can be assembled with housing 230 as shown in FIGS. 20 and 21. Each aperture 238 receives a left-hand lateral contact 252 in one slot 242 and a right-hand lateral contact 252' in the other slot 242 associated with the same aperture. The relationship between the frames and slots of the housing is the same as discussed above. Once again, each is frame is received in the slot of the housing so that the termination elements 260 and 260' project outwardly, beyond the bottom face 232 and ribs 236 of the housing. Here again, the contact frames are disposed on opposite sides of the medial or central plane 240 of the aperture, and the contact cantilever beams slope toward the central plane from the frames. Here, however, the contacts are arranged to cooperate with a male contact beam inserted through the lateral entry opening 247 of the housing. The configuration depicted in FIGS. 20 and 21 is early-make configuration; the contact points 268 and 268' of the cantilever beams are disposed close to the lateral entry aperture 247. To provide a late-make configuration (not shown) the positions of the left-hand and right-hand contacts are reversed, so that the proximal ends of the cantilever beams on both contact are disposed close to the lateral entry aperture 247 and the contact points are disposed far from the lateral entry aperture.

Figure 22:
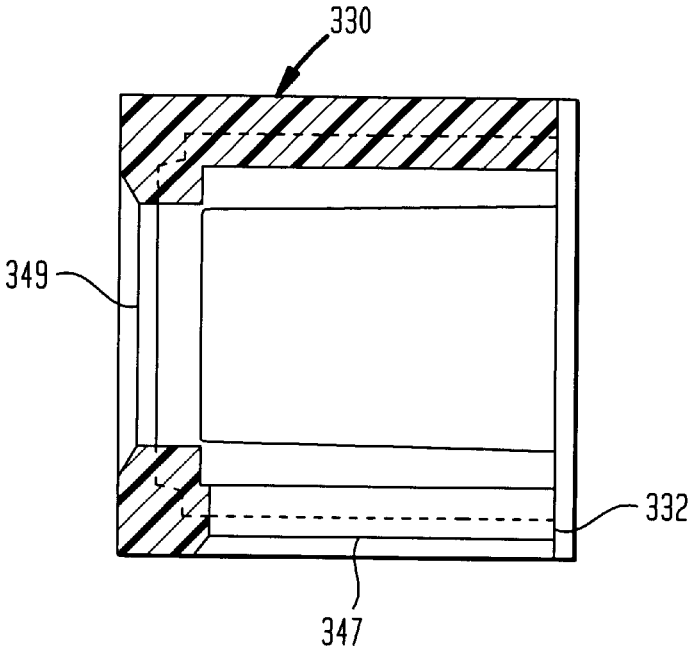
FIG. 22 is a sectional view of a housing used in a further connector according to another embodiment of the invention.
Figure 23:
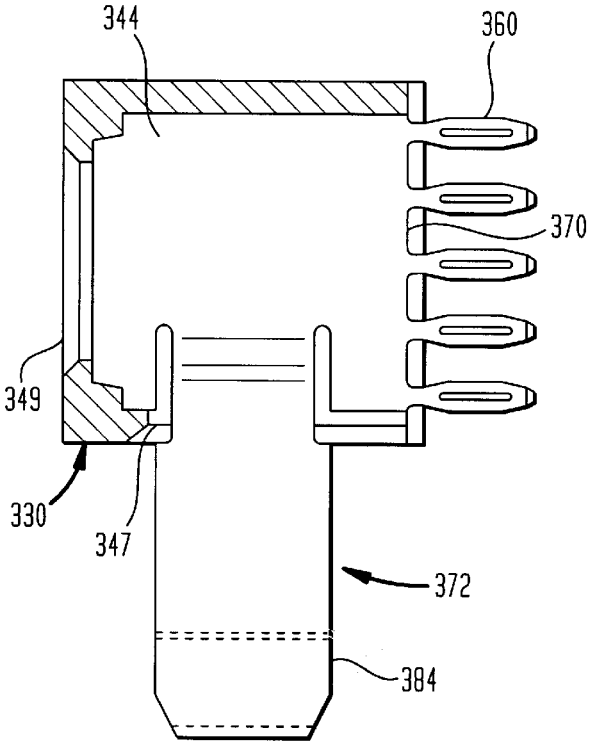
FIGS. 23 and 24 are sectional views depicting a connector incorporating the housing of FIG. 22.
Figure 24:
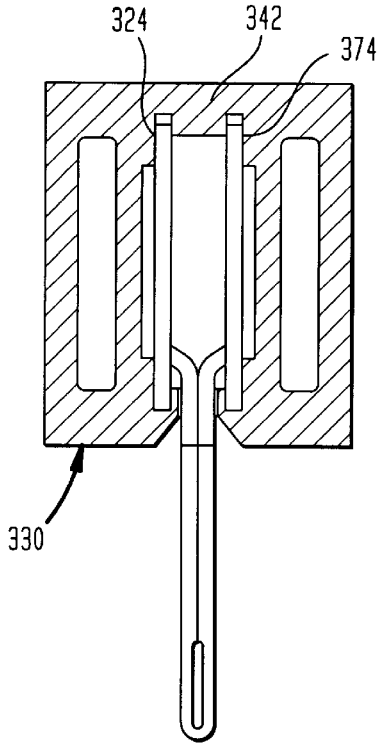

A male connector housing 330 (FIG. 22) is identical to the female connector housing discussed above with reference to FIGS. 16 and 17. However, the lateral entry opening 347 of the male connector housing is in the form of a slot in the lateral entry face 349 extending all the way to the bottom surface 332. Housing 330 can be used with a lateral male contact 372 (FIGS. 23 and 24). Contact 372 is identical to the male contact discussed above with reference to FIG. 7, except that the lateral male contact 372 has a contact beam 384 projecting in a direction parallel to the first or bottom side 370 of contact frames 374. Lateral male contact 372 is engaged in housing 330 so that the contact frames 374 are received in the slots 342 of the housing, whereas the contact beam 384 projects out through the lateral entry opening 347, beyond the lateral entry face 349 of the housing. Once again, the termination elements of the contact project downwardly, beyond the bottom face of the housing and beyond the ribs of the bottom face.

Figure 25:
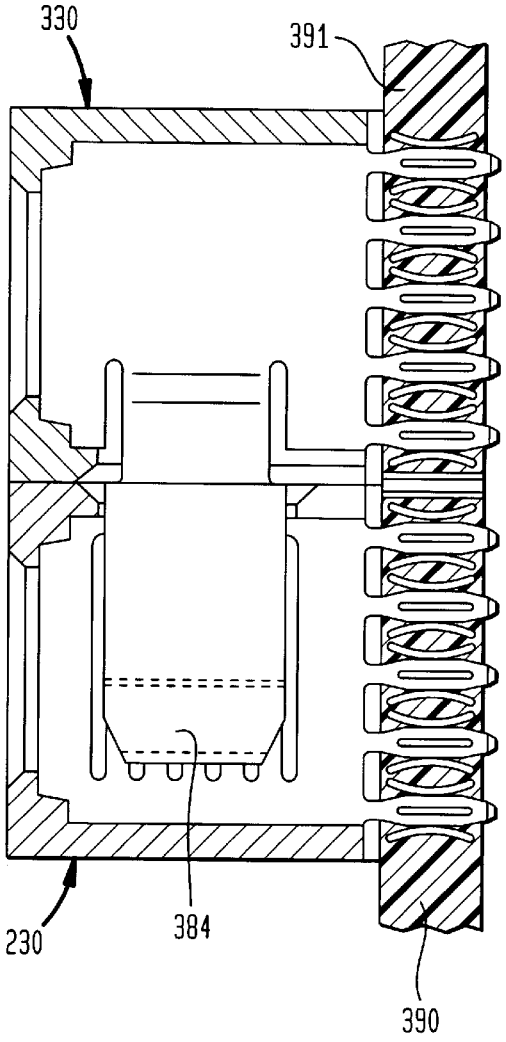
FIGS. 25 and 26 are sectional views depicting the connectors of FIGS. 16–21 mated with the connector of FIGS. 22–24.
Figure 26:
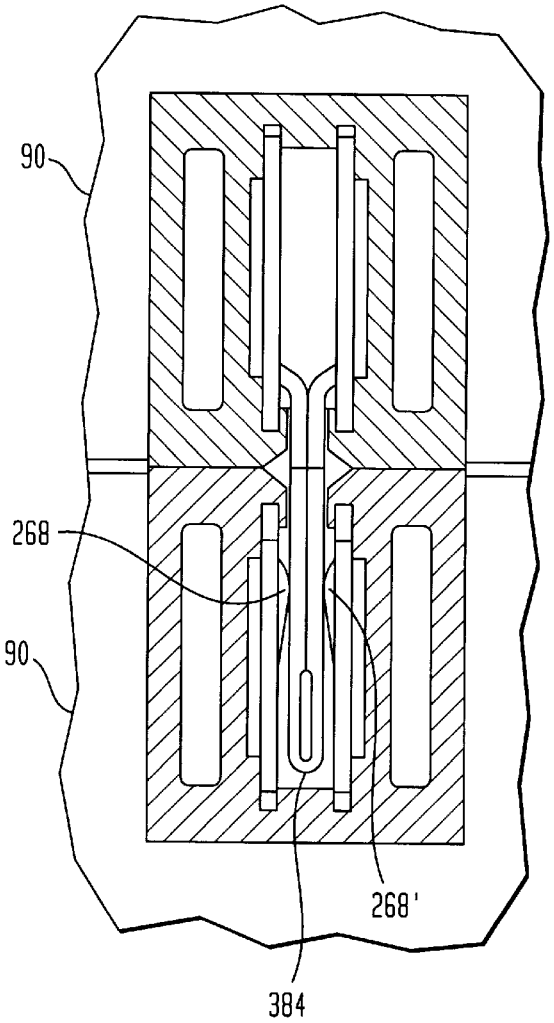

Connectors as discussed above with reference to FIGS. 16–24. However, the connectors desirably are mounted adjacent the edges of circuit panels, such as panels 390 and 391 (FIGS. 25–26), so that when the panels are disposed in a generally edge to edge relationship, the male contact beams 384 of a connector on one panel are engaged with the contact points 268 and 268' of the female contacts of a connector on the other panel.

The lateral connectors can be made with all of the variants discussed above with reference to FIGS. 10–15. Some or all of the apertures in housings 230 and 330 can be assembled with vertical female and male contacts as discussed above with reference to FIG. 5–8 to provide a vertical connector used in the same way as discussed above. The housings 230 and 330 for the lateral connectors can be varied so as to omit the vertical entry opening 248 (FIG. 16) and the vertical entry opening 348 (FIG. 22), if the housing is to be used only for lateral connections. Also, the housing discussed above with reference to FIG. 22, used for the male horizontal connections, can be used for the female horizontal connections as well.

The connectors discussed above can be fabricated in numerous different variations while using different contacts. All of these contacts can be fabricated readily using known, high speed production techniques such as progressive die stamping. In particular, all of the different female contacts can be fabricated using a common progressive die. As is well known in the art, a progressive die is arranged to move a strip of metal through a succession of stations. As the die operates repeatedly, a given section of the strip is conveyed through the various stations in sequence, so that successive operations are performed on such section. Desirably, the progressive die is arranged to treat each section of the strip by first coining a central region of the section so as to reduce the thickness of the sheet in the area which is to form the cantilever beams of the contacts to the desired thickness. The frame is formed from the surrounding metal and the cantilever beams are then punched out of the coined section.

As mentioned above, all of the frames of the female contacts are substantially identical to one another. To change the orientation of the cantilever beams, it is only necessary to change the orientation of the cantilever beam-punching elements relative to the remainder of the die.

Because all of the contact frames used in the female and male contacts have substantially the same shape, and substantially the same size, all of the contacts can be handled and fed by the same automatic assembly equipment, with only minor variations and adjustments. All of this greatly reduces the cost of tooling needed to provide connectors with different combinations of contacts. Further, because only a few different types of contacts are required, and because the same housings can be used with different types of contacts, the cost associated with handling and stocking different parts to provide different connectors are markedly reduced.

Numerous variations of the connectors discussed above can be made. For example, one of the female contacts associated with each aperture 38 can be omitted from the connector shown in FIG. 8. Such a connector would provide only one set of contact point 68 to engage the male contacts and therefore would have significantly lower current capacity. Also, early-make/late-make action can be provided by using male contacts having different contact beam lengths even if all of the female contacts are of the same type.

Figure 27:
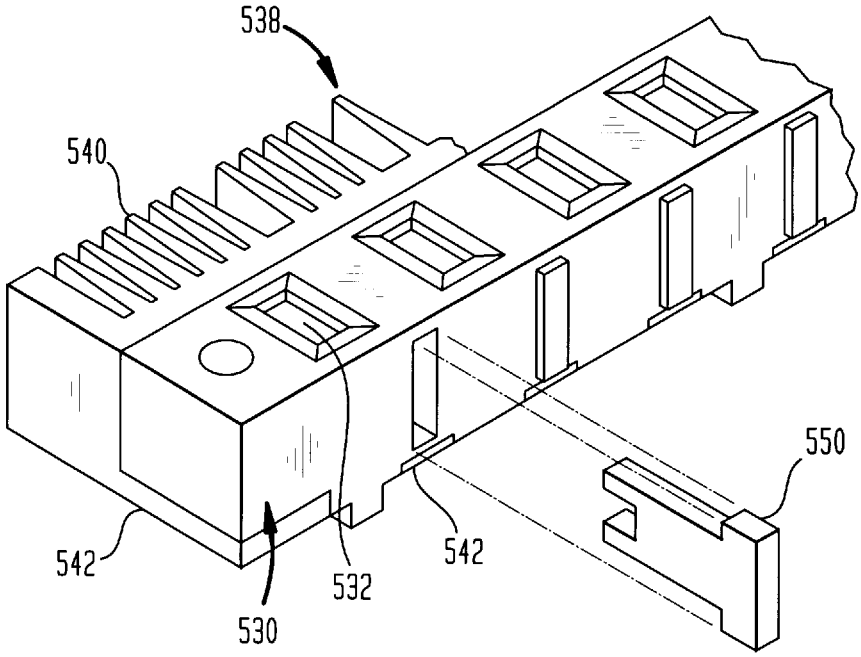
FIG. 27 is a perspective view depicting a connector according to a further embodiment of the invention.
Figure 28:
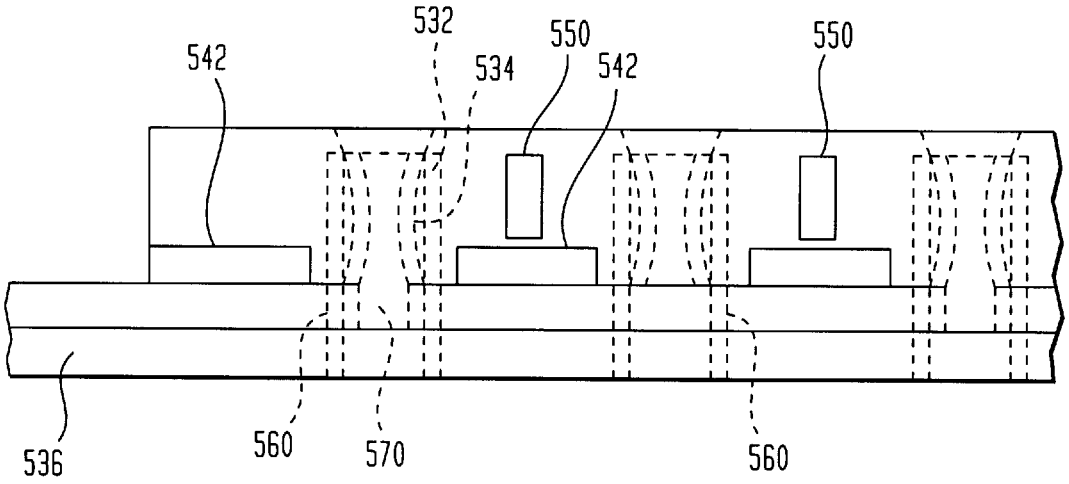
FIG. 28 is an elevational view of the connector shown in FIG. 27.

A connector in accordance with a further embodiment of the invention (FIGS. 27 and 28) includes a dielectric housing 530 having apertures 532 therein and having contacts 534 disposed in the apertures. The contacts and housing may be of the types described above or else may be of conventional configuration. The housing is provided with several features which increase heat transfer from the housing and reduce heat transfer to a circuit panel 536 when the housing is mounted on the circuit panel. A heat dissipation element 538 formed from aluminum or other thermally conductive material is provided on the housing. The heat dissipation element is in the form of a convector having numerous vertically extending ribs 540. The heat dissipation clement also has integrally formed metallic tongues 542 projecting along the bottom surface of the housing. As best seen in FIG. 28, these tongues are spaced apart from one another so that the termination elements 560 of the contacts 534 extend downwardly from the bottom surface of the housing between tongues 542. Additional thermally conductive elements 550 extend through the housing at locations between the apertures 532 and contacts 534. The tongues 542 and thermally conductive elements 550 conduct heat generated within the connector to a heat dissipation element 538. The housing 530 is also provided with standoffs 570 on its bottom surface. The standoffs hold the bottom of the housing, as well as the bottom of the heat dissipation element and tongues 542, up above the top surface of circuit board 536. The termination elements 560 of the contacts 534 extend downwardly from the housing far enough so that the termination elements can still engage the vias of the circuit board even though the housing is held above the circuit board. The space beneath the housing provided by the standoffs allows entry of air for convection cooling of the housing and circuit board. The thermal features discussed above with reference to FIGS. 27 and 28, can be applied regardless of the type of contacts provided. For example, these features can be used with housings having male contacts projecting from them rather than female contacts, or with housings having right angle or lateral contacts as discussed above with reference to FIGS. 17–26.

Figure 29:
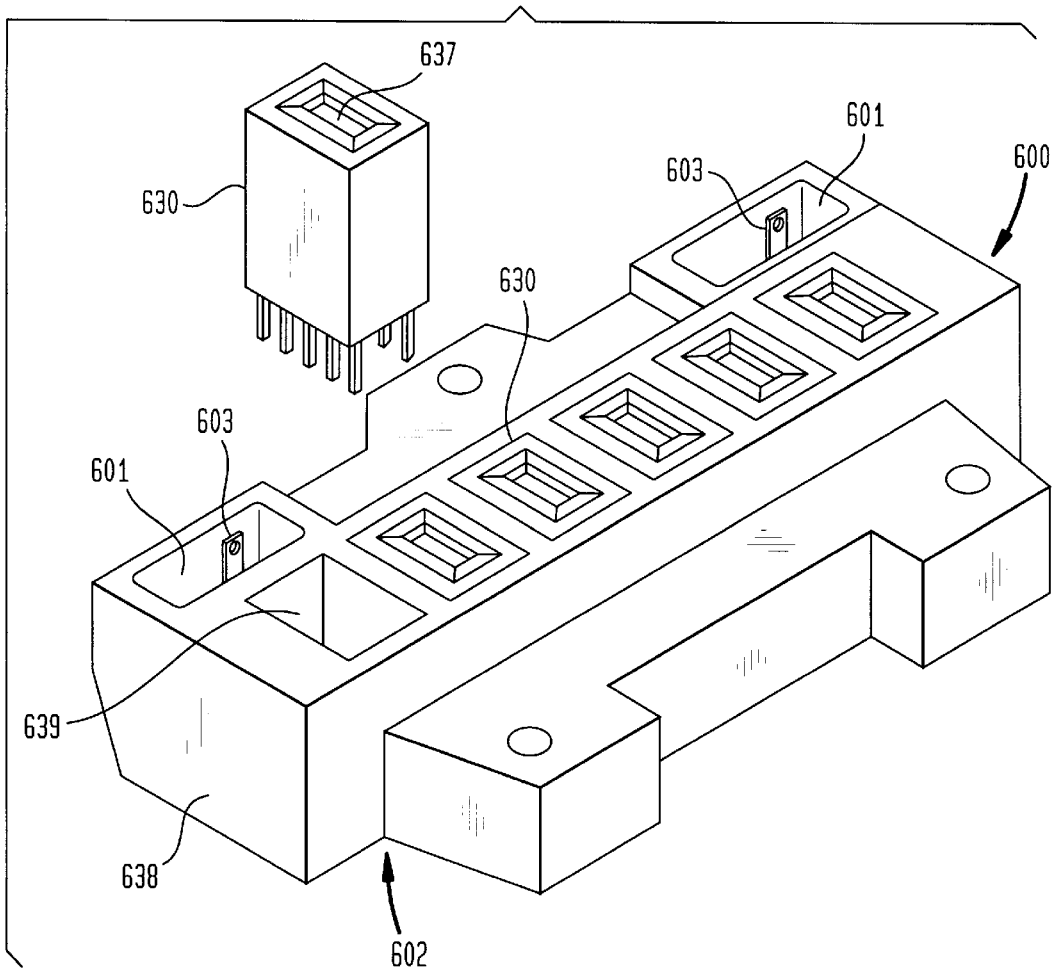
FIG. 29 is a perspective view depicting a connector according to yet another embodiment of the invention.

A connector 600 in accordance with a further embodiment of the invention (FIG. 29) has a metallic heat dissipation element 638 with pockets 639 formed therein. The connector further includes dielectric unit housings 630 adapted to fit within pockets 639. Each unit housing has an aperture 637 for holding a set of contacts. Here again, the contacts may be of any type. The metallic housing serves to dissipate heat generated in the connector. In a variant of this approach, each unit housing may include a plurality of apertures for accepting a plurality of contact sets.

Metallic housing or heat dissipation element 638 has a pair of pilot holes 601. Pilot contacts 603 are mounted in pilot holes 601 but are electrically isolated from the metallic heat dissipation element. A battery or other source of electrical potential 605 is connected between pilot contacts 603. The mating connector has a housing 607 with a pair of guide pins 609 projecting from the housing. Guide pins 609 are adapted to engage holes 601 when the connectors are brought into proximity with one another. The parts are dimensioned so that the guide pins engage the guide holes before the electrical contacts 611 on one connector engage the opposite connector. The guide pins serve to guide the connectors into proper alignment with one another. A lamp 613 is electrically connected between the guide pins 609. When connector 607 is brought into engagement with connector 600, guide pins 609 must be properly aligned with guide holes 601. If the guide pins are properly aligned in the guide holes, they will engage signal contacts 603 to complete the electrical circuit between battery 605 and lamp 613. If the guide pins are not properly aligned with the guide holes, the circuit will not be made and the lamp will remain dark.

Figure 31:
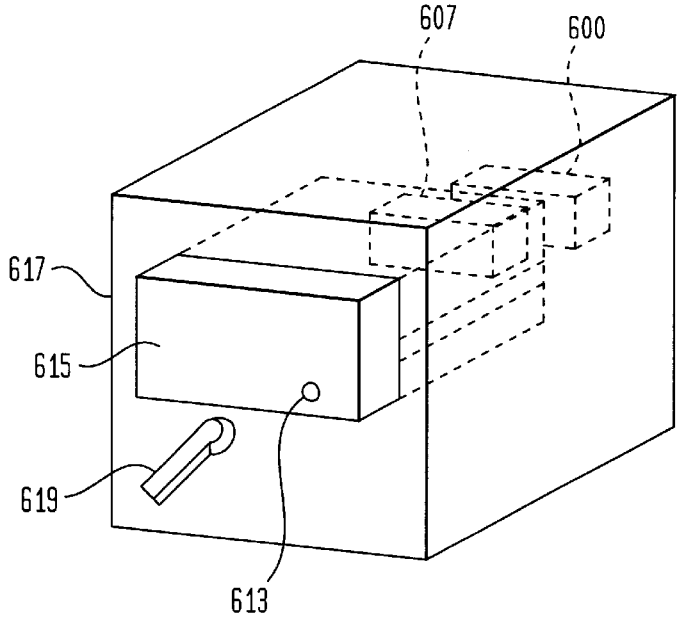
FIG. 31 is a diagrammatic perspective view of a rack-mount electrical device incorporating the connector system of FIG. 30.

This arrangement is particularly useful where the connectors must be engaged with one another while the connectors are concealed from view. For example, rack-mounted electrical equipment (FIG. 31) such as a computer component may include a slide-mounted component 615 and a rack 617 adapted to receive the slide mounted component. The slide mounted component can be engaged with support rails (not shown) on the rack and slid rearwardly, into the rack. Connector 607 may be mounted on the back of slide mounted component 607 whereas the mating connector 600 may be mounted to rack 617 so that the connectors are brought together when the slide mounted component is driven home. The rack or the slide mounted component may include a latch 619 adapted to drive the slide mounted component into its final position relative to the rack.

Typically, a technician installing component 615 into rack 617 cannot see the mating connectors. Depending on dimensional tolerances of the rack and of the slide-in component, the connectors may be seriously misaligned with one another, so that the guide pins 609 on a connector 607 are not aligned with guide holes 601 of the mating connector 600. If the technician were to force the slide-in component into position, as, for example, by actuating lack 619 while the connectors are misaligned, damage to the connectors, the rack or the component could occur. The sensing system prevents such damage. Lamp 613 is mounted on the front of component 615 or rack 617, so that the technician can see the lamp. The lamp thus provides a visible signal indicating proper alignment. The technician slides component 615 into the housing and attempts to align the pins into holes 601. When the lamp is illuminated, the technician knows that the guide pins are properly seated in the guide holes. Thus, the technician will actuate latch 619 to drive the component home only if lamp 613 is illuminated.

Figure 30:
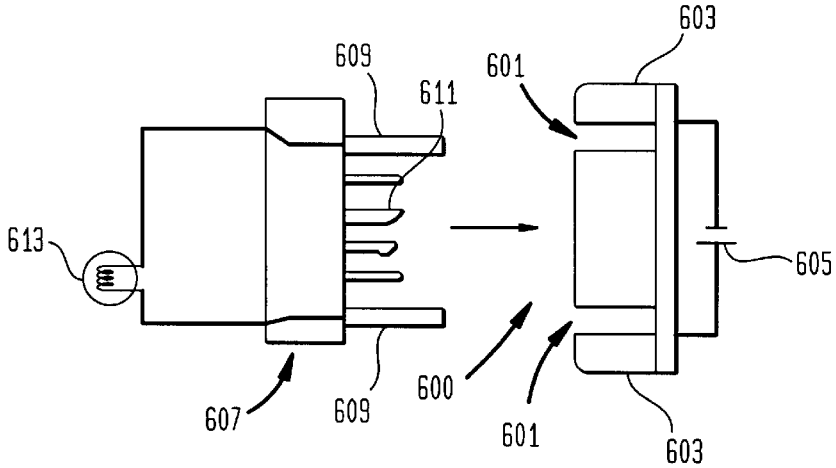
FIG. 30 is a diagrammatic view of a connector system according to yet another embodiment of the invention.

Numerous other signaling devices can be used to provide a human-perceptible signal. For example, the electrical sensing devices discussed above can be replaced with mechanical sensors which trip a mechanical telltale at the front of the component when the guide pins are properly engaged in the guide holes. Optical devices such as fiber optic cables can be employed. In an electrical sensing system, arrangements other than the simple lamp and battery circuit may be used. Thus, capacitive, inductive or other electrical proximity sensing arrangements can be used to detect proper engagement of the guide elements on the connectors. Also, any of these systems can be employed with guide elements other than the pins and holes illustrated in FIGS. 29 and 30. For example, the guide elements may include surfaces arranged for sliding contact. The guide pins, guide holes and sensing devices can be used with elements having dielectric housings, without the particular heat-dissipating arrangements of FIG. 29.

In further variants of this concept, the sensing devices can be linked to an automatic device which inhibits operation of the latching mechanism. For example, a solenoid operated lock may lock the latching mechanism and prevent the technician from operating it unless the signal indicating proper engagement of the guide elements is received. Alternatively, the automatic device may be arranged to actuate the latching mechanism, so as to drive the rack mounted element home automatically if the signal indicating proper engagement of the guide elements is received, and to leave the latch inactive if such signal is not received.

A set of connectors according to a further embodiment of the invention (FIG. 32) includes a female connector having a housing 730 with a bottom surface 732 and a flat portion 733 defining a main portion 734 of the top or entry face. Housing 730 also has a plurality of protruding bosses 735 connected to one another by the flat portion 733. Bosses 735 and projecting upwardly from the flat portion. Each boss 735 defines a portion 737 of the top or entry surface at the tip of the boss. Each boss has an aperture 738 formed within it and opening to the entry surface portion 737 at the tip of the boss. The features of apertures 738 and the associated structures within the housing may be the same as the features of the apertures 38 discussed above with reference to FIGS. 1–4. Female contacts 752 are received in apertures 738 in the same manner as the female contacts discussed above. The female contacts used in housing 730 may include any combination of the contact types discussed above with reference to FIGS. 1–6 and 10–14.

The mating male connector includes a housing 760 having a bottom face 762 and having a top or entry face with a main region 764 and with depressions 766 defining recessed portions 767 of the entry face. Each depression 766 in the entry face is surrounded by the dielectric material of the housing. Housing 760 has apertures 768 extending through the recessed portions 767 of the entry face. Here again, the apertures and contact-receiving features may be the same as those discussed above. Male contacts 772 are received in apertures 768 of housing 760. The contact beams 784 of the male contacts project through the recessed portions 767 of the entry face. However, the contact beams do not extend above the level of the main portion 764 of the entry face. Thus, each male contact beam 782 is surrounded by the dielectric material of the housing, except at the top opening of the recess. Therefore, the male contact beams are protected against accidental contact with personnel or with electrically conductive elements in the environment. This affords increased protection against injury to personnel or damage to the electrical circuits connected to the male contact beams. Depressions 766 are disposed at spacings corresponding to the spacings between bosses 735 on the female connector housing 730. In use, the connector housings are mounted on printed circuit boards or on other elements in the same manner as discussed above. When the elements carrying the housings are brought together, the housings 730 and 760 are engaged with one another so that bosses 735 are received in depressions 766. The male contact beams 782 enter the apertures 738 of the female contact housing 730 and engage the female contacts in the same manner as discussed above.

Figure 32:
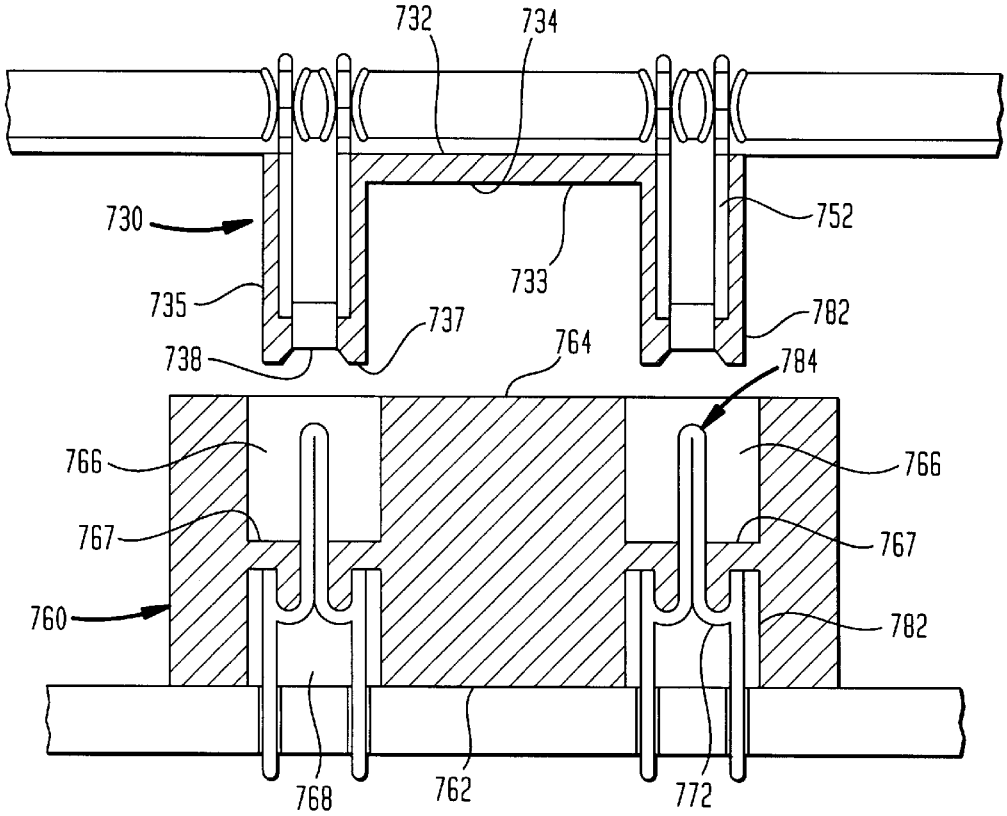
FIG. 32 is a diagrammatic sectional view depicting connectors according to further embodiments of the invention.

In a variation of the construction shown in FIG. 32, each boss 735 of the female contact housing may have more than one aperture and may hold more than one set of female contacts 752. The mating male connector will have a corresponding number of male contact beams 784 disposed in each depression 766.

As these and other variations and combinations of the features discussed above can be utilized without departing from the present invention as defined by the claims, the foregoing description should be taken by way of illustration rather than by way of limitation of the invention as claimed.

What is claimed is:

1. An electrical connector comprising:

(a) a housing having an entry face and a plurality of apertures open to the entry face, each said aperture having a central plane;

(b) a plurality of female contacts positioned within at least some of said apertures so that each said contact is associated with one of the apertures, each said female contact including a contact body secured to the housing and one or more flexible cantilever beams having proximal ends connected to the contact body and distal ends remote from the contact body, said one or more female contacts associated with at least one said aperture being early-make contacts with cantilever beams having distal ends adjacent the entry face and proximal ends remote from the entry face, said one or more contacts associated with at least one other said aperture being late-make contacts with cantilever beams having distal ends remote from the entry face and proximal ends adjacent the entry face.

2. A connector as claimed in claim 1 wherein said housing has contact-mounting features associated with said apertures, said contact bodies of said female contacts being engaged with said contact-mounting features associated with the apertures holding said female contacts, the apertures and contact-mounting features associated with said early-make contacts being identical with said apertures and contact-mounting features associated with said late-make contacts.

3. A connector as claimed in claim 2 further comprising one or more male contacts having contact bodies and contact beams extending from said contact bodies, said contact bodies of said male contacts being disposed in one or more of said apertures of said housing and engaged with said contact mounting features associated with apertures holding said male contacts, the apertures and contact-mounting features associated with said male contacts being identical with said apertures and contact-mounting features associated with said female contacts.

4. A connector as claimed in claim 1 wherein at least some of said apertures have pairs of said female contacts disposed therein, the contact bodies of each such pair being disposed on opposite sides of the central plane of the aperture housing such pair.

5. A connector as claimed in claim 1 wherein at least some of the female contacts are integral contacts having the cantilever beams formed integrally with the contact bodies.

6. A connector as claimed in claim 5 wherein in at least some of the integral contacts, the contact body has a first thickness and at least a portion of each said cantilever beam has a second thickness less than the first thickness.

7. A connector as claimed in claim 6 wherein in at least some of said integral contacts, the entirety of each said cantilever beam has the second thickness.

8. A connector as claimed in claim 5 wherein the contact bodies of said female contacts are generally planar, polygonal frames, each such polygonal frame having a plurality of sides extending at least partially around a central opening, the cantilever beams associated with each of said polygonal frames having proximal ends connected to a proximal side of such frames and distal ends projecting across the central opening.

9. A connector as claimed in claim 8 wherein said housing defines contact-receiving slots in each said aperture, said frames being disposed in said slots.

10. A connector as claimed in claim 9 wherein said apertures and slots associated with said early-make contacts are identical with said apertures and slots associated with said late-make contacts, said late make contacts having said frames positioned in said slots with said proximal sides adjacent the entry face, said early make contacts having said frames positioned in said slots with said proximal sides remote from the entry face.

11. A connector as claimed in claim 1 wherein said housing has a bottom face facing in a downward direction and said entry face faces upwardly, away from said mounting face, said female contacts having said cantilever beams extending generally vertically.

12. A connector as claimed in claim 11 wherein at least some of said contacts have termination elements formed integrally with the contact bodies and projecting downwardly beyond said bottom face.

13. A connector as claimed in claim 1 wherein said housing has a bottom face facing in a downward direction and said entry face faces in a horizontal direction transverse to the downward direction, said female contacts having said cantilever beams extending generally horizontally.

14. A connector as claimed in claim 13 wherein at least some of said contacts have termination elements formed integrally with the contact bodies and projecting downwardly beyond said bottom face.

15. An electrical connector comprising:

(a) a housing having an entry face and a plurality of apertures open to the entry face, each aperture having a central plane and a pair of slots remote from the central plane;

(b) one or more male contacts positioned within the apertures so that each said contact is associated with one of the apertures, each said male contact including a pair of generally planar contact bodies positioned in the slots of the associated aperture and a contact beam projecting from said contact bodies, the contact beam of each said male contact having a proximal end connected to the contact bodies of such male contact and a distal end projecting out of the aperture associated with such male contact beyond the entry face of the housing.

16. A connector as claimed in claim 15 wherein each said contact beam includes a pair of generally planar beam elements, said beam elements cooperatively defining a composite beam, said beam elements facing one another and being connected to one another at said distal end of said composite beam.

17. A connector as claimed in claim 16 wherein at least some of said male contacts are integral contacts having said beam elements formed integrally with said contact bodies.

18. A connector as claimed in claim 16 wherein in at least some of said male contacts, the beam elements constituting the composite beam of a male contact are formed integrally with one another.

19. A connector as claimed in claim 16 further comprising a conductive filler disposed within at least some of said composite beams between the beam elements constituting such composite beams, said conductive filler substantially filling any spaces between such beam elements.

20. A connector as claimed in claim 16 wherein at least some of said male contacts have a plurality of termination elements formed integrally with said contact bodies, said housing having a bottom face, said termination elements projecting downwardly beyond said bottom face of said housing.

21. A contact for an electrical connector comprising a planar polygonal metallic frame including a plurality of frame members defining and at least partially surrounding an opening;

one or more metallic cantilever beams integral with said frame projecting from one of said frame members partially across said opening, each said cantilever beam having a proximal end at said one of said frame members and a distal end remote from said one of said frame members, said cantilever beams projecting out of the plane of said frame; and one or more termination elements formed integrally with said frame and projecting generally in the plane of said frame and outwardly away from said opening, said termination elements projecting from an edge of one of said frame members remote from said opening.

22. A contact as claimed in claim 21 wherein at least some portions of said cantilever beams are thinner than said frame.

23. A contact as claimed in claim 22 wherein said at least one cantilever beam includes a plurality of cantilever beams extending generally parallel to one another.

24. A contact as claimed in claim 23 wherein each said cantilever beam has a contact point disposed between the proximal and distal ends of the cantilever beam, the contact point of each said cantilever beam being remote from the plane of the frame, the proximal and distal ends of each said cantilever beam being adjacent the plane of the frame, each said cantilever beam sloping gradually toward the plane of the frame from its contact point to the distal end of the cantilever beam.

25. A contact as claimed in claim 24 wherein the contact points of said cantilever beams are disposed in a first row, the contact further comprising adjunct cantilever beams connected to the same edge member as the aforesaid cantilever beams, each said adjunct cantilever beam having a contact point remote from the plane of the frame and having proximal and distal ends adjacent the plane of the frame, each said adjunct cantilever beam sloping gradually toward the plane of the frame from said contact point to the distal end of the adjunct cantilever beam, said contact points of said adjunct cantilever beams being disposed in a second row parallel to the first row.

26. A contact as claimed in claim 21 wherein said termination elements include compliant press-fit termination elements, each said compliant press-fit termination element including a pair of legs extending generally codirectionally away from the frame member.

27. A set including a plurality of contacts as claimed in claim 21 wherein some of said contacts have said cantilever beams projecting from the same one of said frame members as the termination elements, so that said distal ends of said cantilever beams point away from said termination elements, whereas others of said contacts have said cantilever beams projecting from a first one of said frame members towards a second one of said frame members parallel to the first one of said frame members, and have said cantilever beams projecting from said second one of said frame members so that said distal ends of said cantilever beams point towards said termination elements.

28. A set including a plurality of contacts as claimed in claim 21 wherein said frame members of each said contact include first, second, third and fourth frame members, said third and fourth frame members being parallel to one another and transverse to said first frame member, each said contact having said termination elements projecting from said first frame member, some of said contacts having said cantilever beams projecting from said third frame member towards said fourth frame member so that distal ends of said cantilever beams point in a first direction parallel to said third edge member, others of said contacts having said cantilever beams projecting from said fourth frame member towards said third frame member so that distal ends of said cantilever beams point in a second direction parallel to said third edge member and opposite to said first direction.

29. A male contact for an electrical connector comprising an integral, unitary element including a pair of generally planar contact bodies spaced apart from one another and parallel one another so that said contact bodies define a central plane therebetween, and an elongated beam element projecting from each said contact body, said beam elements having distal ends remote from said contact bodies, said beam elements joining one another at said distal ends so that said beam elements cooperatively form a composite beam, said unitary element including a plurality of termination elements projecting from edges of said contact bodies remote from said beam elements, each said contact body having a bottom edge, said termination elements projecting downwardly from said bottom edges of said contact bodies, said composite beam projecting horizontally from said contact bodies so that said composite beam extends generally parallel to said bottom edge.

30. A contact as claimed in claim 29 wherein each said termination element includes an elongated member extending downwardly away from the bottom edge of the contact body and an opening within said elongated member so that the elongated member is compressible.

31. A male contact for an electrical connector comprising an integral, unitary element including a pair of generally planar contact bodies spaced apart from one another and parallel one another so that said contact bodies define a central plane therebetween, and an elongated beam element projecting from each said contact body, said beam elements having distal ends remote from said contact bodies, said beam elements joining one another at said distal ends so that said beam elements cooperatively form a composite beam, said unitary element including a plurality of termination elements projecting from edges of said contact bodies remote from said beam elements, said beam elements being disposed closer to said central plane than said contact bodies, said unitary element includes sections extending inwardly, toward the central plane, from said contact bodies to said beam elements so that said contact bodies are connected to said beam elements by said inwardly-extending sections.

32. A contact as claimed in claim 31 wherein said beam elements are generally planar beam elements, said generally planar beam elements confronting one another.

33. A contact as claimed in claim 32 wherein said beam elements have sections of reduced thickness at the distal ends thereof, said sections of reduced thickness joining one another at a fold.

34. A contact as claimed in claim 33 wherein said beam elements abut one another at locations remote from said sections of reduced thickness.

35. A contact as claimed in claim 33 wherein each of said beam elements is about 0.025 inches thick except at said sections of reduced thickness.

* * * * *

UNITED STATES PATENT AND TRADEMARK OFFICE

CERTIFICATE OF CORRECTION

PATENT NO. : 6,299,492 B1 
DATED : October 9, 2001
INVENTOR(S) : John M. Pierini and Christopher Weaver It is certified that error appears in the above-identified patent and that said Letters Patent is hereby corrected as shown below:

Column 1,
Line 16, “used in numerous” should read -- the common household --.

Column 3,
Line 49, “arc” should read -- are --.

Column 9,
Line 37, “arc” should read -- are --.
Line 40, “arc” should read -- are --.

Column 10,
Line 4, “11 8” should read -- 118 --.

Column 20,
Line 35, “33” should read -- 34 --.

Signed and Sealed this

Twenty-sixth Day of November, 2002

*Attest:*

*Attesting Officer*

JAMES E. ROGAN
*Director of the United States Patent and Trademark Office*